US009896913B2

(12) United States Patent
Nyhavn et al.

(10) Patent No.: US 9,896,913 B2
(45) Date of Patent: Feb. 20, 2018

(54) PETROLEUM WELL TRACER RELEASE FLOW SHUNT CHAMBER

(71) Applicant: RESMAN AS, Ranheim (NO)

(72) Inventors: Fridtjof Nyhavn, Trondheim (NO); Christian Andresen, Vikhammer (NO); Gaute Oftedal, Trondheim (NO)

(73) Assignee: RESMAN AS, Ranheim (NO)

( * ) Notice: Subject to any disclaimer, the term of this patent is extended or adjusted under 35 U.S.C. 154(b) by 204 days.

(21) Appl. No.: 14/915,167

(22) PCT Filed: Aug. 30, 2013

(86) PCT No.: PCT/NO2013/050142
§ 371 (c)(1),
(2) Date: Feb. 26, 2016

(87) PCT Pub. No.: WO2015/030596
PCT Pub. Date: Mar. 5, 2015

(65) Prior Publication Data

US 2016/0201454 A1 Jul. 14, 2016

(51) Int. Cl.

| | |
|---|---|
| ***E21B 47/11*** | (2012.01) |
| ***E21B 43/08*** | (2006.01) |
| ***E21B 27/00*** | (2006.01) |
| ***E21B 47/06*** | (2012.01) |
| ***E21B 49/08*** | (2006.01) |
| ***E21B 27/02*** | (2006.01) |
| ***E21B 47/10*** | (2012.01) |

(52) U.S. Cl.
CPC ..... *E21B 43/08* (2013.01); *E21B 27/00* (2013.01); *E21B 27/02* (2013.01); *E21B 47/06* (2013.01); *E21B 47/1015* (2013.01); *E21B 49/086* (2013.01)

(58) Field of Classification Search
None
See application file for complete search history.

(56) References Cited

U.S. PATENT DOCUMENTS

| | | | | |
|---|---|---|---|---|
| 2,617,941 | A * | 11/1952 | Craggs | E21B 47/1015 222/386.5 |
| 4,166,216 | A * | 8/1979 | Cubberly, Jr. | E21B 47/1015 250/260 |
| 4,421,166 | A | 12/1983 | Cain | |
| 8,567,497 | B2 * | 10/2013 | Moen | E21B 47/1015 166/252.6 |
| 2003/0131991 | A1 | 7/2003 | Hartog et al. | |

(Continued)

*Primary Examiner* — Jill Culler
(74) *Attorney, Agent, or Firm* — Birch, Stewart, Kolasch & Birch, LLP

(57) ABSTRACT

A petroleum well tracer release flow shunt chamber in an annulus space about a base pipe and method of estimating one or more pressure differences or gradients, wherein the flow shunt chamber extending generally axial-parallel with the base pipe, and provided with a shunt flow passage for holding a shunt chamber fluid, and including a tracer system exposed to and arranged for releasing unique tracer molecules at a generally even release time rate to the shunt chamber fluid, a first inlet aperture for receiving a first fluid, a second outlet aperture for releasing the shunt chamber fluid to a fluid, a flow restrictor allowing a pressure gradient between the inlet and outlet apertures driving the shunt chamber fluid out via the flow restrictor.

28 Claims, 16 Drawing Sheets

(56) References Cited

U.S. PATENT DOCUMENTS

Figure 1:
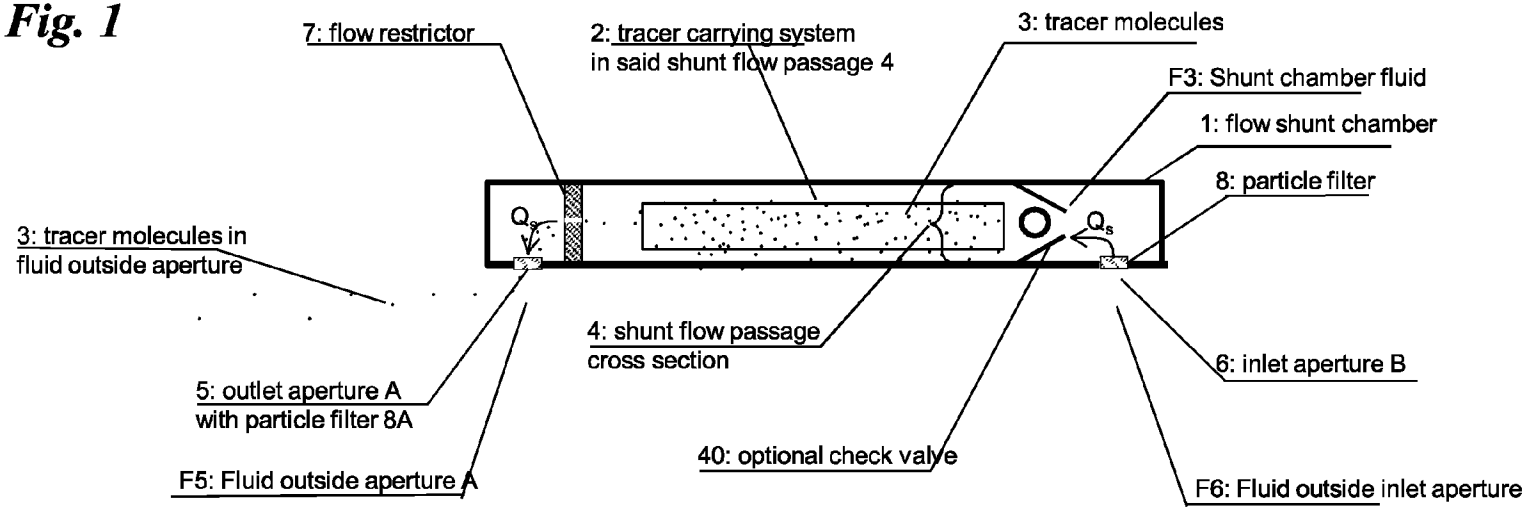

| | | | | |
|---|---|---|---|---|
| 2004/0084186 | A1* | 5/2004 | Allison | E21B 27/02<br>166/305.1 |
| 2011/0024111 | A1 | 2/2011 | Moen et al. | |
| 2011/0277544 | A1 | 11/2011 | Rytlewski et al. | |

* cited by examiner

Particle filter on base pipe example

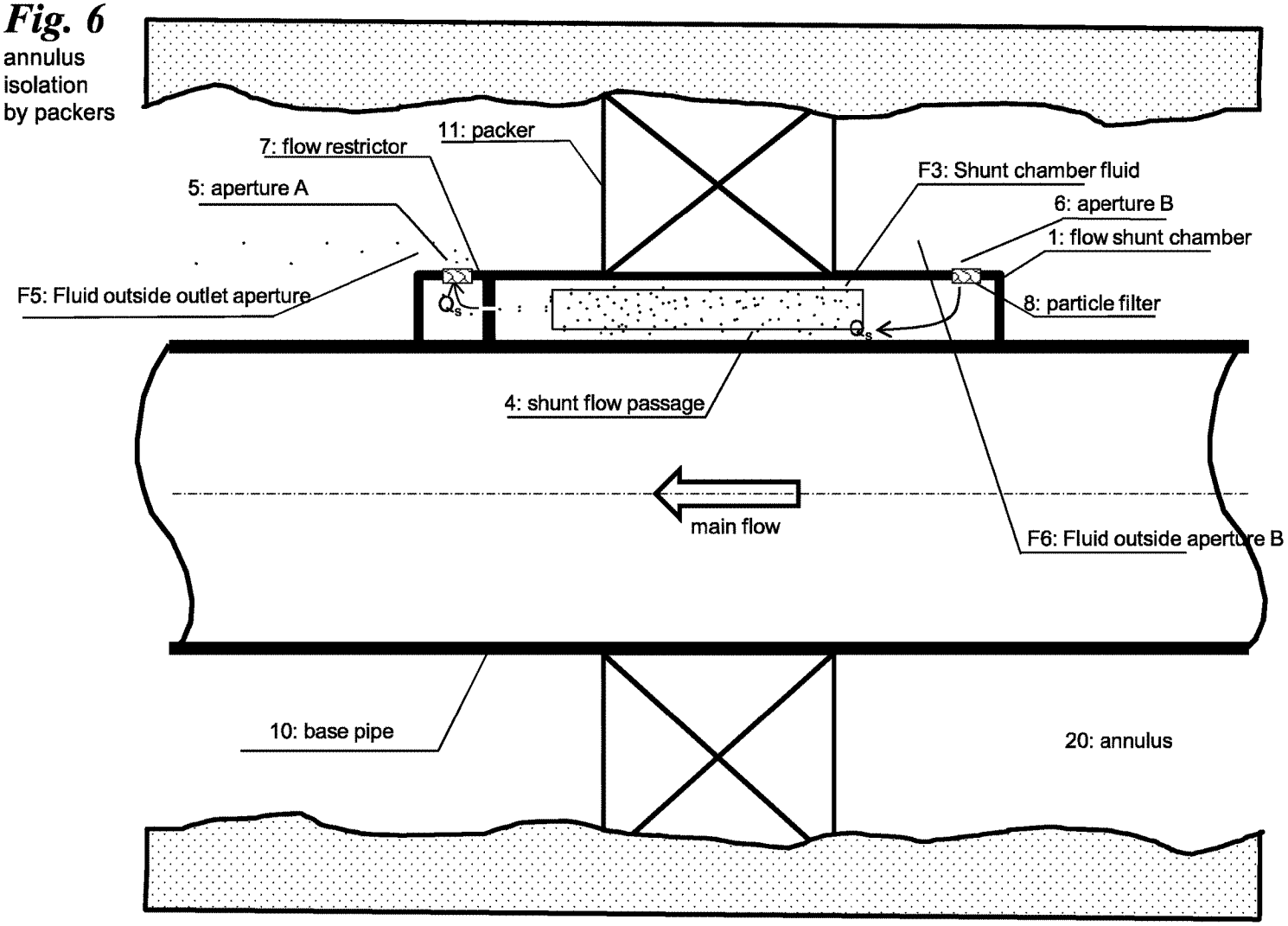
*Fig. 6* annulus isolation by packers annulus isolation by cement annulus
isolation
by packers

*Fig. 7,*
tracer transient with step rate change
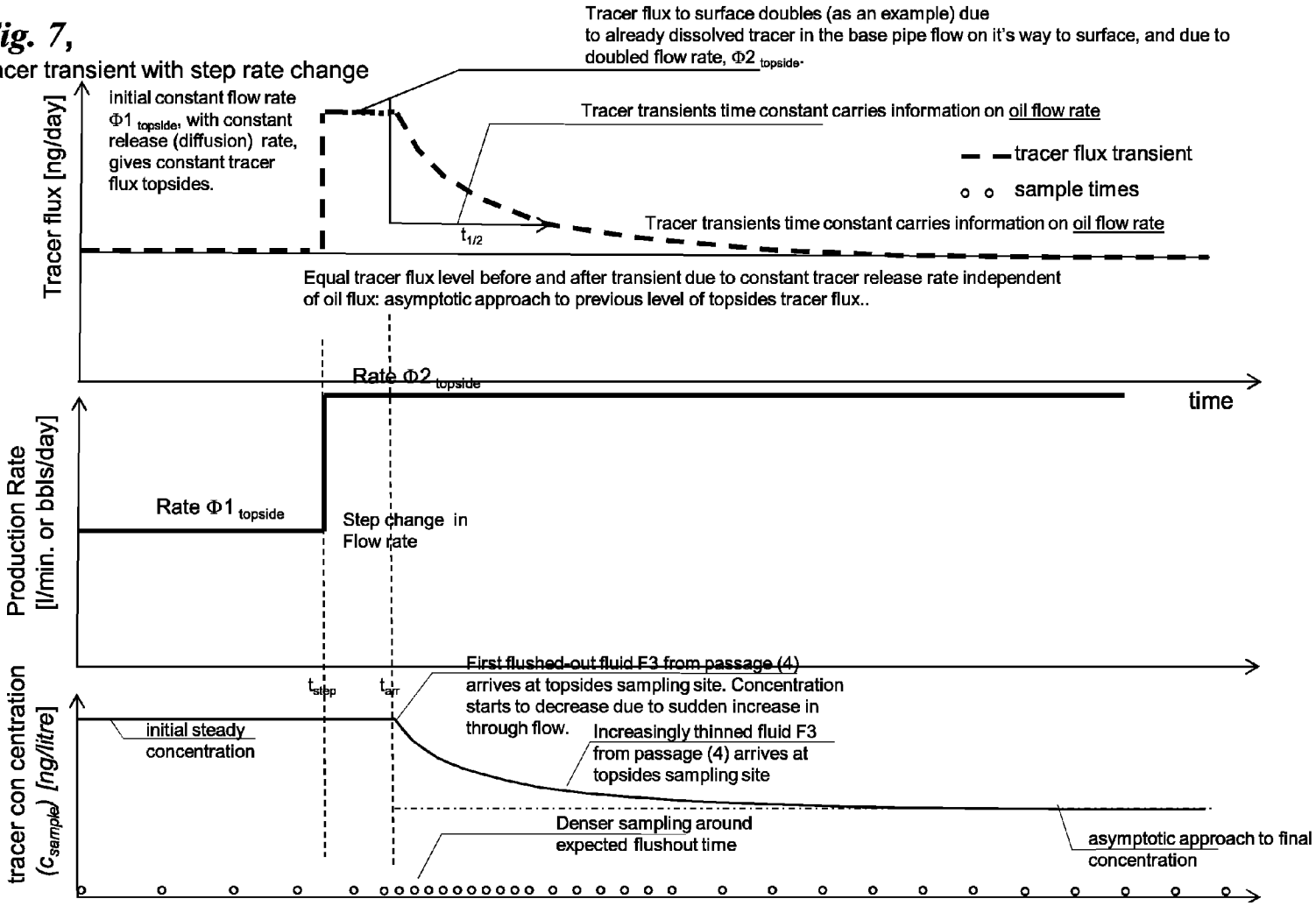

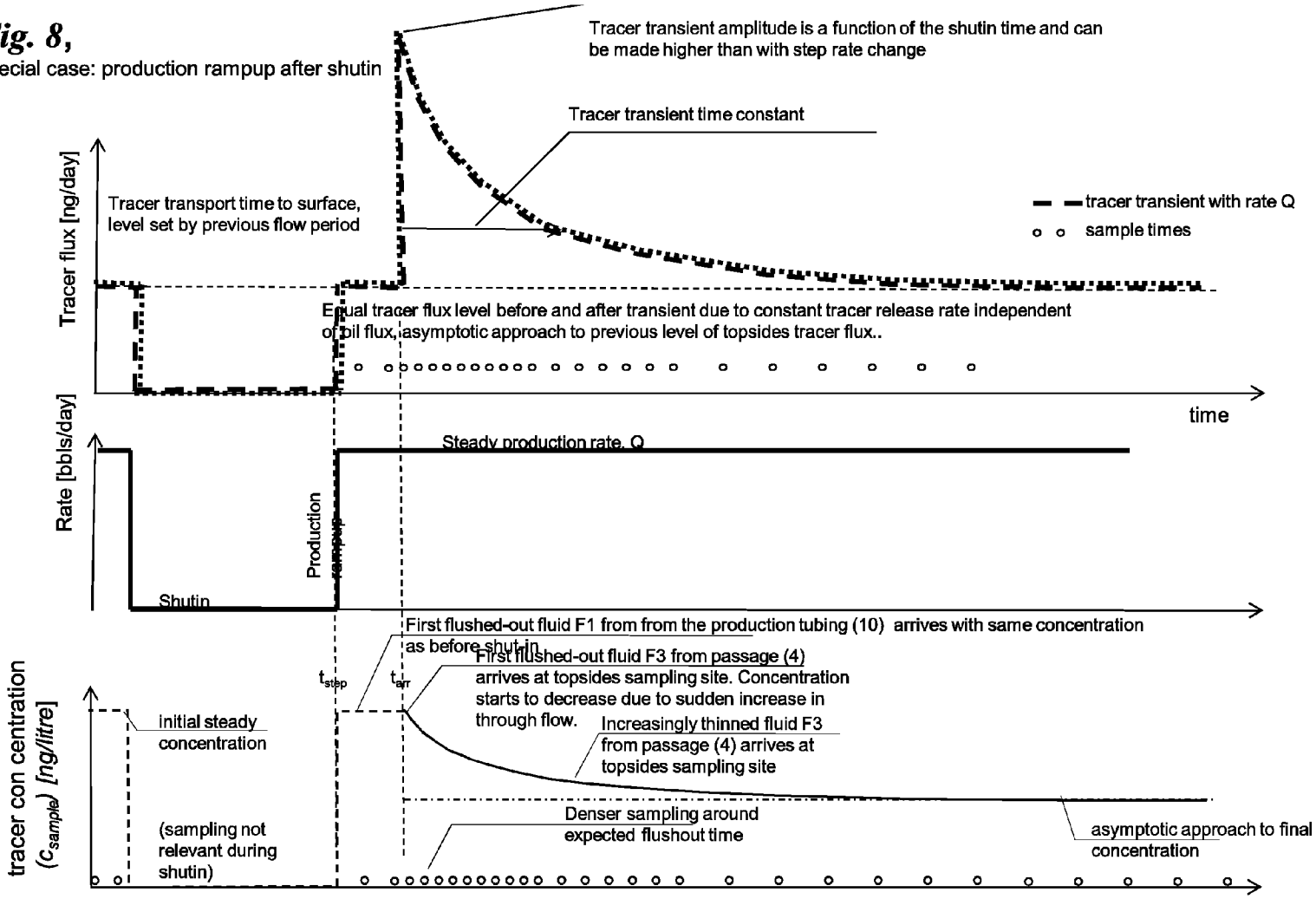
*Fig. 8,* special case: production rampup after shutin example: two zone monitoring (remember that the total flow at any place is the cumulative influx at every zone upstream (further down/in in the well))

*Figure 10*, two-zone monitoring by tracer transient with step rate change in production topsides.
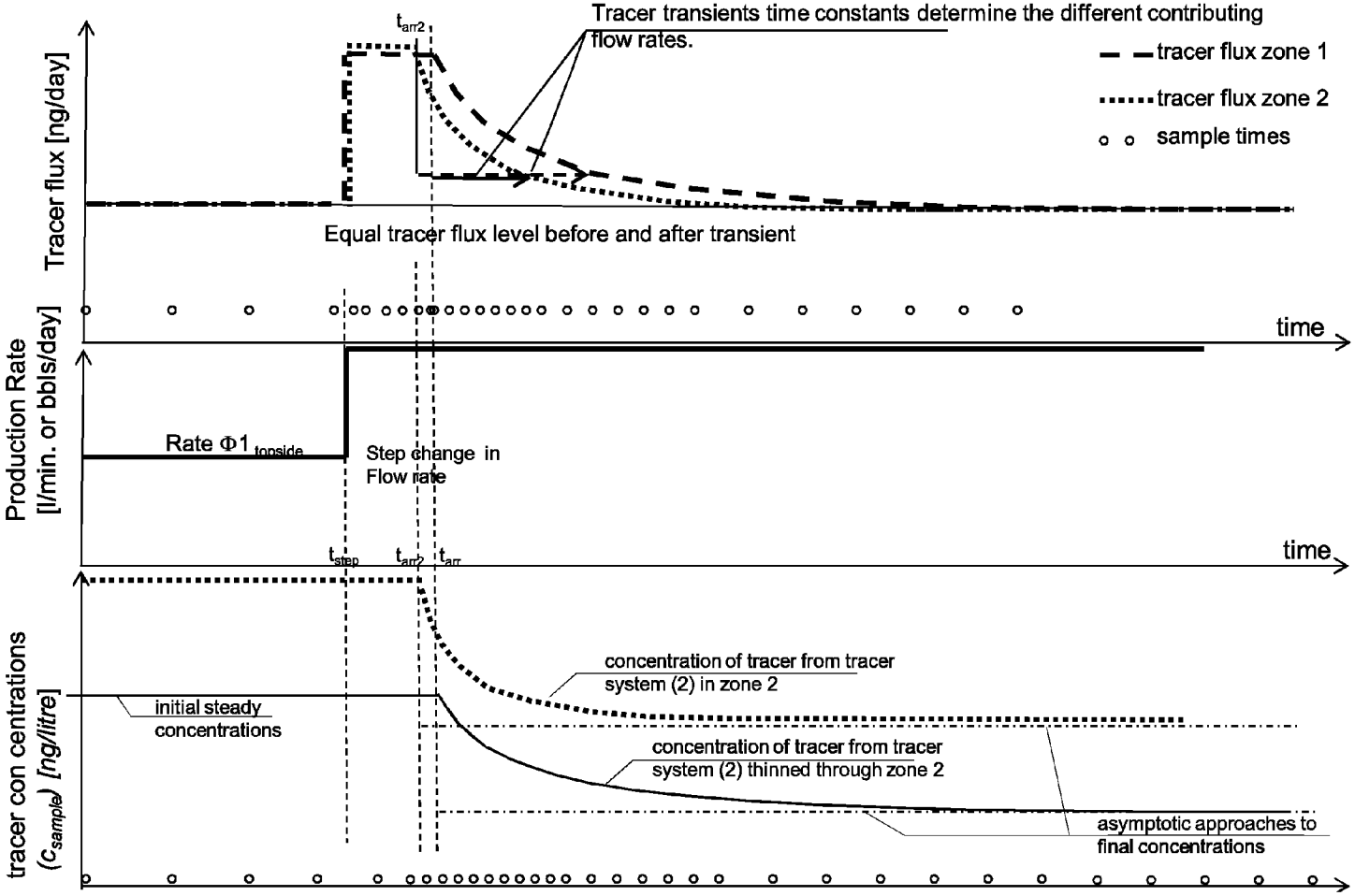

two-zone monitoring by tracer transient with step negative rate change: the method still applies.

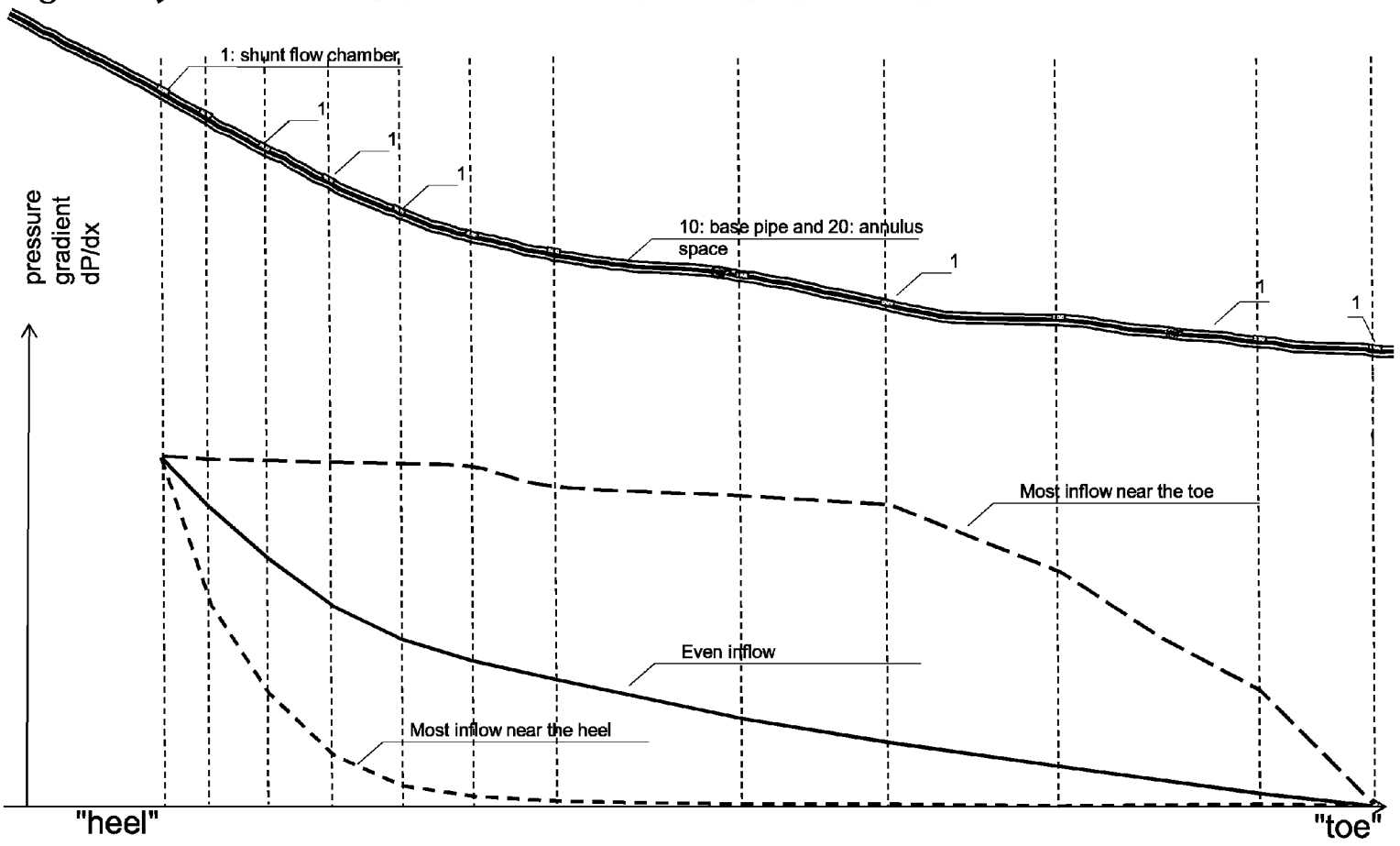
*Figure 11*, multi-zone monitoring by tracer transient with step rate change in production topsides.

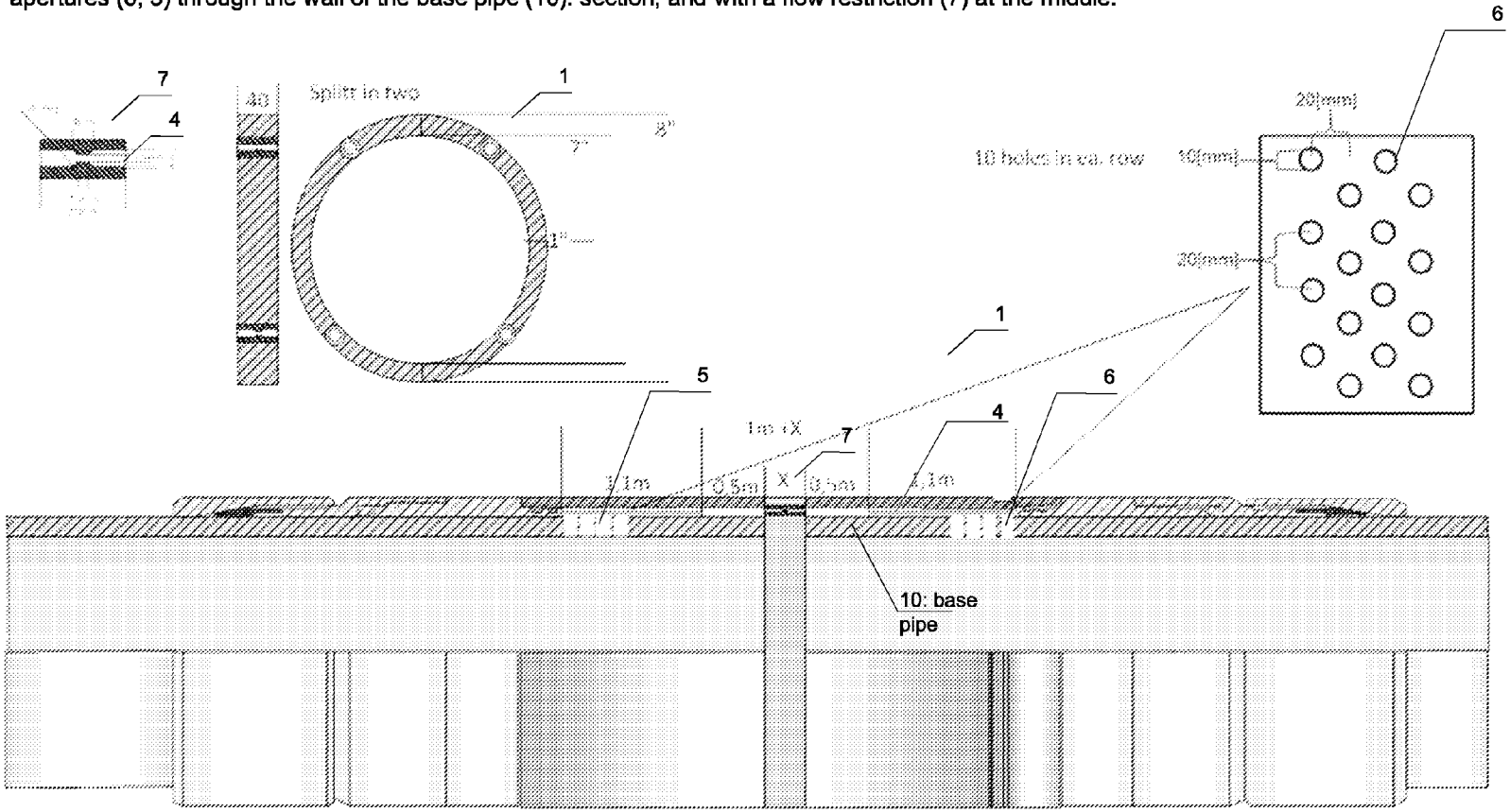
*Figure 12,* An embodiment of the invention with a flow shunt chamber (1) arranged with inlet and outlet apertures (6, 5) through the wall of the base pipe (10). section, and with a flow restriction (7) at the middle.

PETROLEUM WELL TRACER RELEASE FLOW SHUNT CHAMBER

FIELD OF THE INVENTION

The invention is in the field of wellbore flow monitoring. More specifically, the invention is used for indicating/estimating the so-called Wellbore Pressure Drawdown, i.e. a wellbore pressure drop curve, over tubing joints (short or long), along the borehole. The pressure drawdown is primarily caused by the friction between the flowing fluids and the borehole wall. If the pressure drop is estimated and linked with so-called drawdown/velocity (i.e. pressure gradient/velocity models the inflow profile along the wellbore may be estimated or better understood. The invention is based on the exploitation of tracer transients that originate in the production zone.

BACKGROUND ART

Permanent tracers in producer wells have by the applicant Resman and others been proven for estimating "what flows where and how much", i.e. which fluids flow in which parts of the well, and at which flow rates. Traditionally, different tracers have been placed in different influx zones to a production completion installed in a well. These tracers may be released as a function of downhole properties like flow velocity, by the affinity to different fluids or by mechanical devices. Topsides sampling and analysis of the concentration curves of the different tracers is used to provide information on which fluids are flowing into which zones, and may also indicate and at which rates the influx occurs in those influx zones.

In the present context, a tracer system (2) is a material unit which releases tracer molecules (3), such as a rod of moulded matrix material having tracer molecules (3) dispersed in the matrix, said tracer molecules e.g. diffusing out at an even time rate. Different Tracer Systems and different Tracer Carrier Systems for such tracer systems have been tried out, particularly polymer tracer systems arranged in parallel slot spaces around a base pipe of the completion, and the applicant has accumulated knowledge that points towards the fact that transient tracer responses created during flow transients depend on the nature of the void enveloping the tracer system, so-called delay chambers, and the venting properties of such delay chambers. In this context, a base pipe is an established term for a central pipe, usually of steel, but which may be made in other materials. The Central pipe is an inner pipe into which the production fluid enters in the production zone, and which leads downstream all the way up to topside, although there may be some rearrangement of the piping at the wellhead.

BRIEF SUMMARY OF THE INVENTION

The invention is petroleum well tracer release flow shunt chamber (1) arranged in an annulus space (20) about a base pipe (10) in a petroleum well said flow shunt chamber (1) extending generally axial-parallel with said basepipe (10), said flow shunt chamber (1) provided with a shunt flow passage (4) for holding a shunt chamber fluid (F3), said flow shunt chamber (1) further comprising:

a tracer system (2) in said shunt flow passage (4), said tracer system (2) exposed to and arranged for releasing unique tracer molecules (3) at a generally even release time rate to said shunt chamber fluid (F3)

a first inlet aperture (6) to said flow shunt passage (4) for receiving a first fluid (F6) from outside said inlet aperture (6), a second outlet aperture (5) from said shunt flow passage (4) arranged downstream of said first inlet aperture (6) said second outlet aperture (5) for releasing said shunt chamber fluid (F3) to a fluid (F5) outside said second outlet aperture (5), a flow restrictor (7) arranged between said tracer system (2) and said second outlet aperture (6), allowing a pressure gradient between said inlet and outlet apertures (6, 5) driving said shunt chamber fluid (F3) out via said flow restrictor (7).

The invention is also the petroleum well tracer release flow shunt chamber (1) above, for being arranged in said annulus space (20) about said base pipe (10), having the defined properties above.

The invention in another aspect is a method of estimating one or more pressure differences or gradients along a producing petroleum well with a completion with a base pipe (10) in an annulus (20) and with one or more flow shunt chambers (1) according to claim 1 with unique tracer molecules (3) and arranged along part or all of said base pipe (10), allowing well fluids to flow at a stable, first production flow rate ($\Phi 1_{topside}$), and changing said flow to a second production flow rate ($\Phi 2_{topside}$), all while collecting a time-stamped series of fluid samples from said well fluids at a topsides sampling location, analyzing said series of fluid samples for concentrations ($c1_{sample}(t_i)$), ($c2_{sample}(t_i)$), . . . ($cn_{sample}(t_i)$), calculating topsides tracer flux rate ($\rho_{topside}$) versus time curves from said concentrations ($ci_{sample}(t_i)$) and said flow rates ($\Phi\iota_{topside}$) for each tracer molecule (3) type identifying tracer flux transients associated with the change to said second production flow rate, based on said tracer flux rate curves, calculating time constants ($t_{i1/2}$) for each tracer flux transient for each tracer molecule (3) type for said flow shunt chambers (1), based on said time constants ($t_{i1/2}$), estimating a pressure difference between said inlet aperture (6) and said outlet aperture (1) of each flow shunt chamber (1).

BRIEF FIGURE CAPTIONS

FIG. 1 illustrates an embodiment of the invention which is a shunt flow chamber (1) with an inlet aperture (6) to a shunt flow passage (4) which holds a tracer system (2) which releases tracer molecules (3) to the shunt chamber fluid (F3) present within the flow passage (4), and with a flow restrictor (7) and an outlet aperture (5). There is a filter (8) arranged at least at the inlet aperture (6) in order particularly to prevent clogging of particles of sand, organic matter, steel and cuttings which are ubiquitous in a petroleum fluid flow in a well. Advantageously there is also a filter (8A) arranged at the outlet aperture (5) in order to prevent clogging during installation or flushing or otherwise reverse temporary flow. The fluid restriction property of the flow restrictor (7) preferably dominates over the other components' (6, 4, 5, 8, 8A) fluid restriction properties in order to feasibly control and calibrate the fluid restrictor (7).

In all the embodiments of the present invention, the volume fluid flux per time unit, $\Phi_{basepipe}$ and/or $\Phi_{annulus}$ is/are in the range of liters/second or more and are significantly and considerably larger than the volume fluid flux ($\Phi_{chamber}$) which should be in the milliliters/second or less range through the shunt flow passage (4).

Figure 1B:
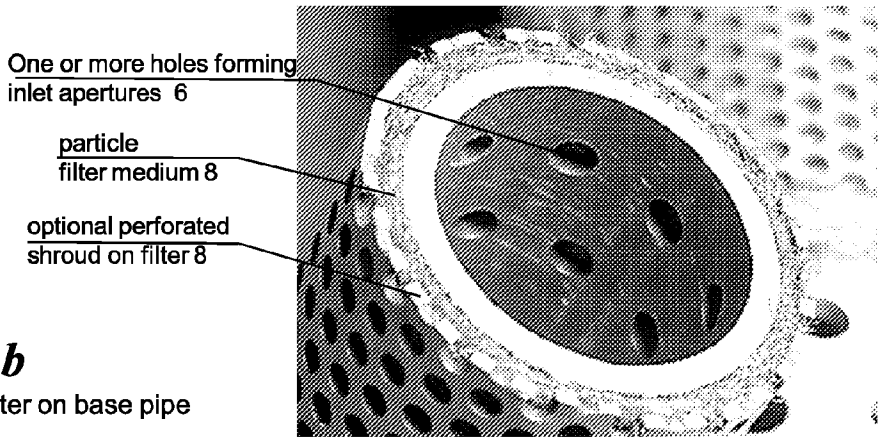

FIG. 1*b* illustrates a cross-section of an example of a particle filter (8) installed between a base pipe (10) with apertures (6) to a filter (8) to a surrounding position at the peripheral surface for installation of a shunt flow chamber (1) (not shown in FIG. 1*b*).

Figure 1A:
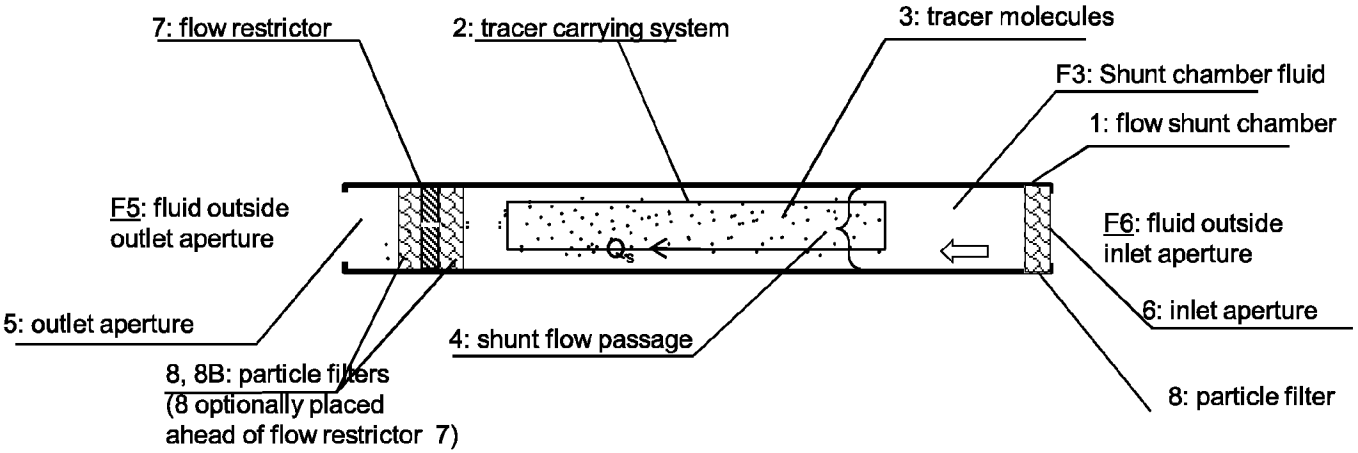

FIG. 1*a* shows a more general embodiment of the flow shunt chamber (1) with a wide open inlet aperture (6). The inlet aperture may be from an upstream fluid (F6) either in the base pipe (10) or in the annulus (20) (both shown in FIG. 2). From the inlet aperture (6) there is generally a shunt flow passage (4) with a tracer system (2), e.g. a polymer rod doped with tracer molecule material (3) which diffuses at a steady rate out to the environment, and with a particle filter (8) ahead of the flow restrictor (7) and another particle filter (8A) downstream of the flow restrictor (7), and here a wide open outlet aperture (5) to the downstream surrounding fluid (F5), which may be in the base pipe or in the annulus. As a general comment to the embodiment in FIG. 1*a* with its wide open inlet aperture (6) one could say that one has not much control of "reverse" flow of disseminated tracer molecules (3) in the upstream direction under halted or very reduced flow conditions.

Figure 1C:
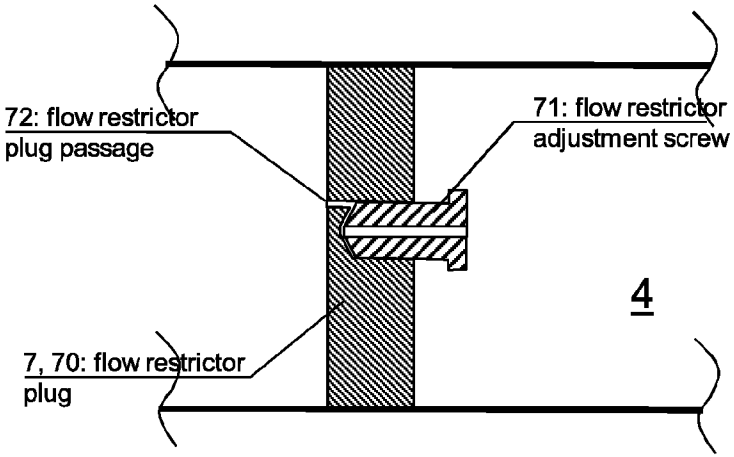

FIG. 1*c* illustrates an embodiment of the flow restrictor, which may comprise an interchangeable flow restrictor plug (70) in the flow passage (4), the flow restrictor plug (70) provided with a flow restrictor passage (72) of a given cross-section area. Alternatively, adjusting the flow restrictor (7) may be done e.g. by adjusting the cross-section of the flow restrictor passage (72) by means of a flow adjustment screw (71) in the flow restrictor plug passage (72) in the flow restrictor plug (70).

Figure 2:
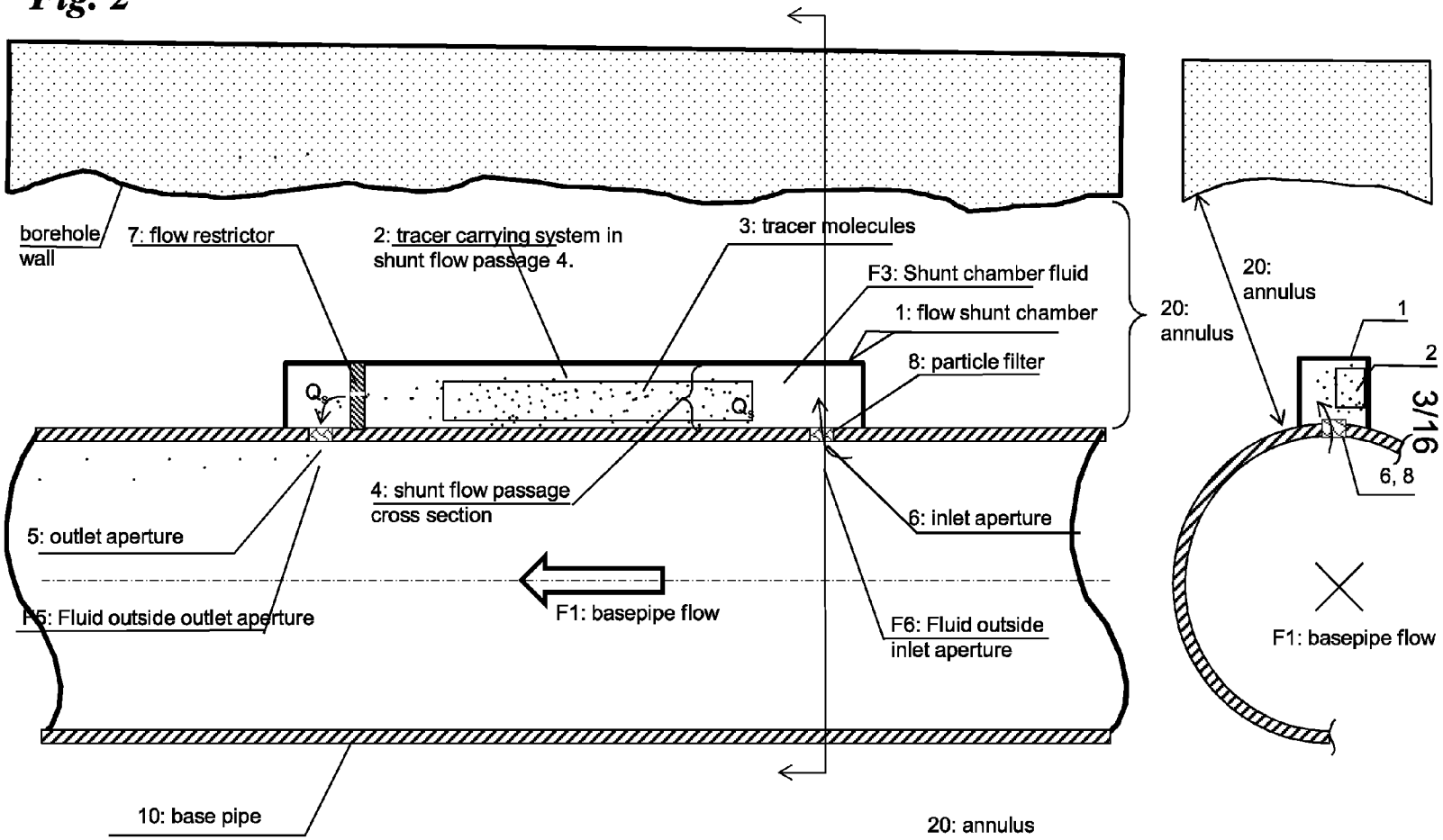

FIG. 2 is an illustration of an embodiment of the invention arranged for estimating the basepipe flow (F1) alone. In this embodiment the flow shunt chamber (1) is arranged with influx aperture (6) and outlet aperture (5) both on a base pipe (10) in a completion in an annulus (10) space (20) formed in a wellbore in a rock. Here the particle filter (8) is in the aperture (6), likewise a particle filter (8B) is arranged in the outlet aperture (5). Longitudinal section to the left, and cross-section to the right side of the sheet. Here it is illustrated that a "cloud" of released tracer molecules around the tracer system (2), and the cloud is slowly transported out through the flow restrictor passage (7) and the outlet aperture (5) to the fluid (F5) outside the outlet aperture (5) which in this embodiment is the basepipe flow (F1) itself.

Figure 3:
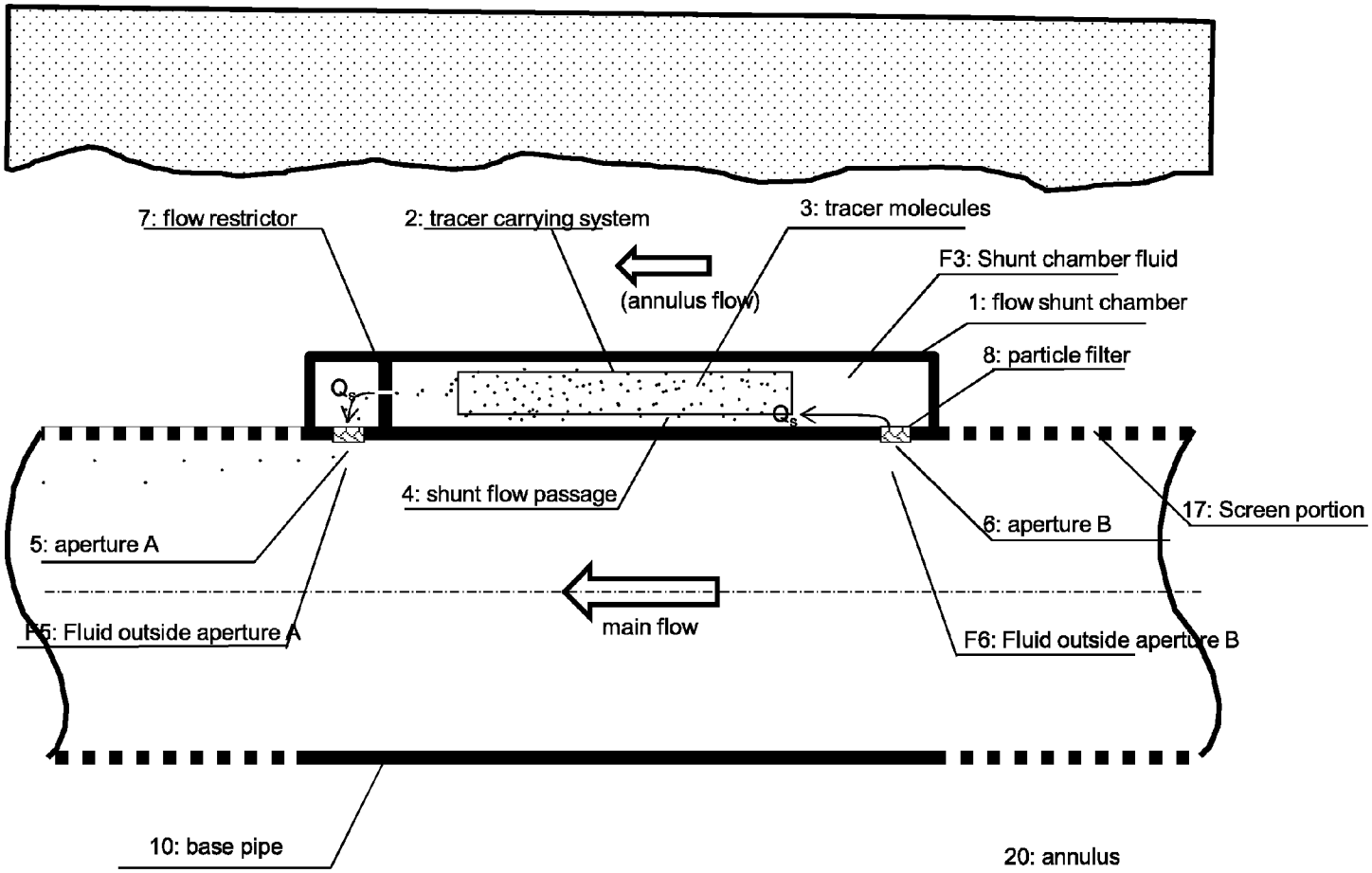

FIG. 3 is also a longitudinal section taken along the centre of a base pipe (10) as with FIG. 2. The only difference is that the base pipe comprises a fluid-permeable screen to the right, a blank pipe with a flow shunt chamber of the invention and with the apertures (6, 5) from the blank pipe. This embodiment will have no radial gradient between the main flow in the base pipe (10) and the annulus (20) flow, so the flow shunt chamber may be used for estimating the total flow past this flow shunt chamber. The pressure near aperture (6) will be equal in the base pipe (10), the aperture (6) and in the annulus (20) as we may assume little or no radial pressure gradient. The same observation applies around outlet aperture (5).

Figure 4:
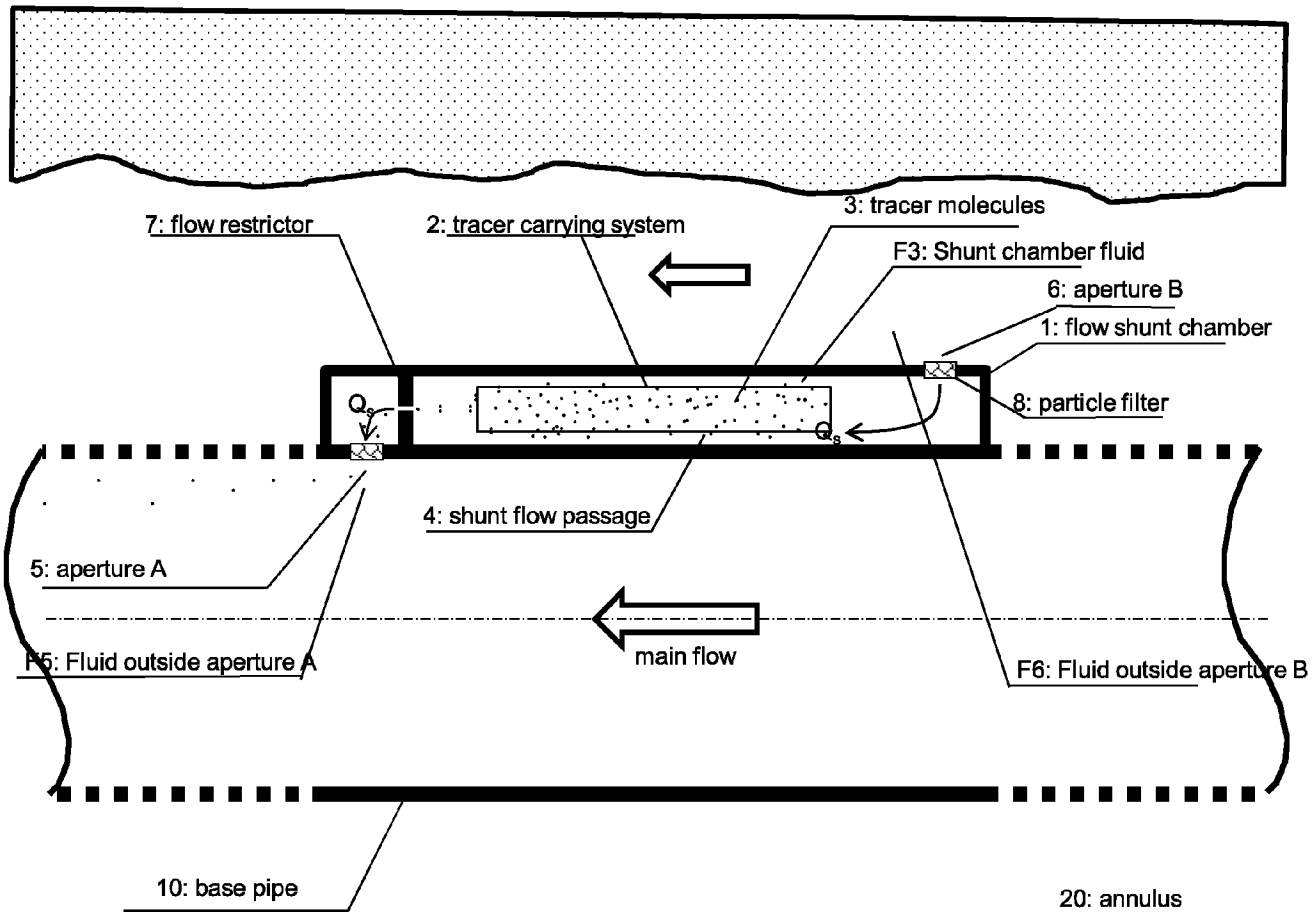

FIG. 4 shows an embodiment similar to the one of FIG. 3, with the difference that the inlet aperture (6) is facing towards the annulus (20). It is also possible to make a variant embodiment of the one of FIG. 4 wherein there is arranged inlet apertures (6) both facing the annulus (20) side and through the base pipe (10). Additionally, it is also possible to make an embodiment wherein there is outlet apertures (5) facing the annulus (20) and the base pipe (10). Either of those two embodiments may be arranged on a blank base pipe or on a pipe with apertures upstream and downstream of the flow shunt chamber (1) such as illustrated in FIG. 4.

Figure 5:
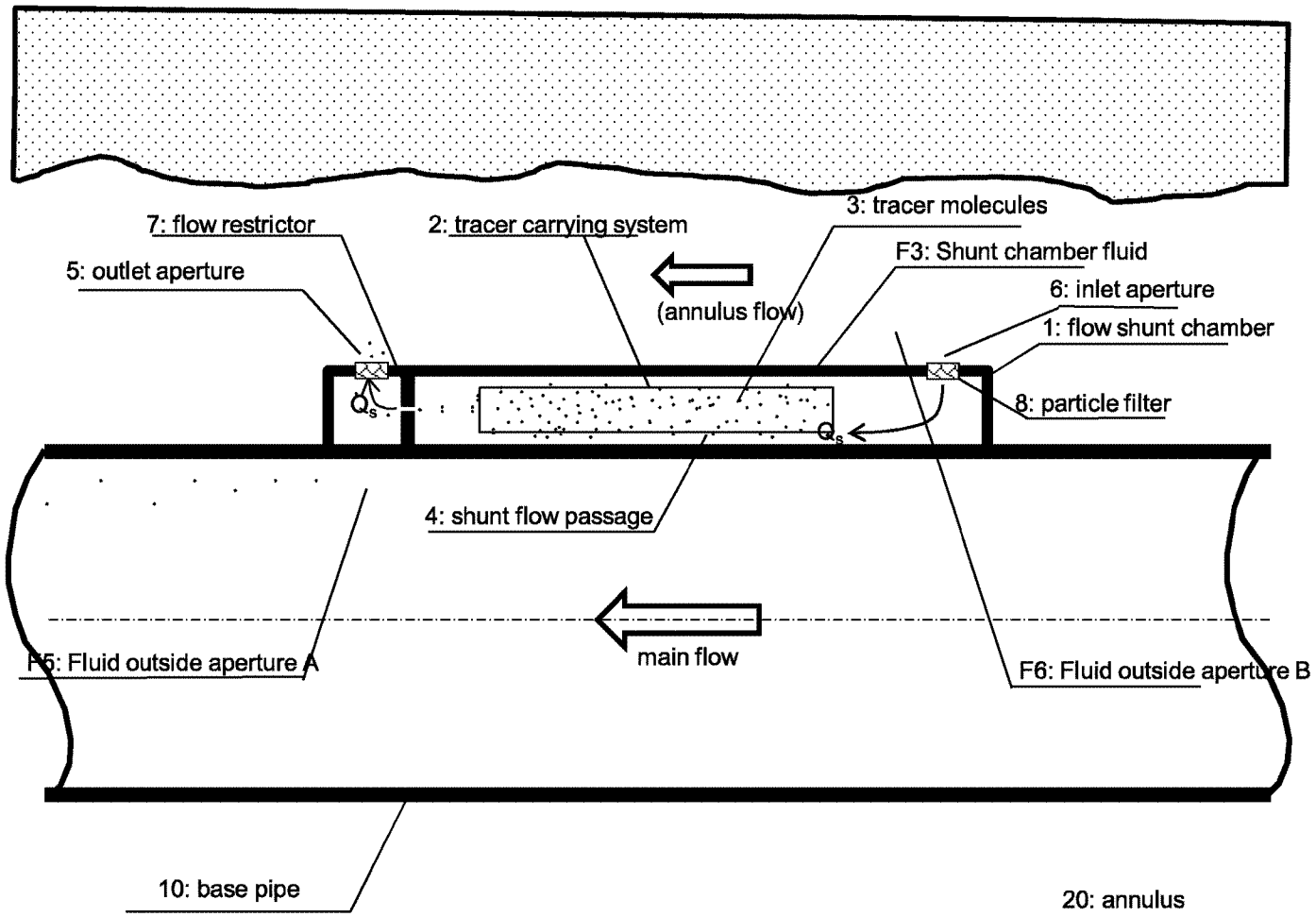

FIG. 5 illustrates a further development in the series from FIGS. 3 and 4, here with the outlet aperture (5) also facing the annulus space (20).

FIG. 6 illustrates an embodiment of the invention wherein a packer (11) is arranged about a blank basepipe (10) with a flow shunt chamber (1) according to the invention, with the inlet aperture (6) facing the annulus (20). Thus the outside fluid (F6) is in the annulus. Likewise, the outlet aperture (5) faces the annulus (20) downstream of the packer, so the outside fluid (F5) is in the annullus, too. The pressure across the packer will thus drive a very small flow through the shunt flow passage (4), and if the outside fluid (F5) is subsequently led to the main flow (F1) through an aperture in the base pipe (10) downstream of the present packer-isolated annulus flow shunt chamber (1) the pressure across the packer (11) may be estimated. A variant embodiment with a screen upstream and downstream of the flow shunt chamber would be possible but may render the packer less useful.

Figure 6A:
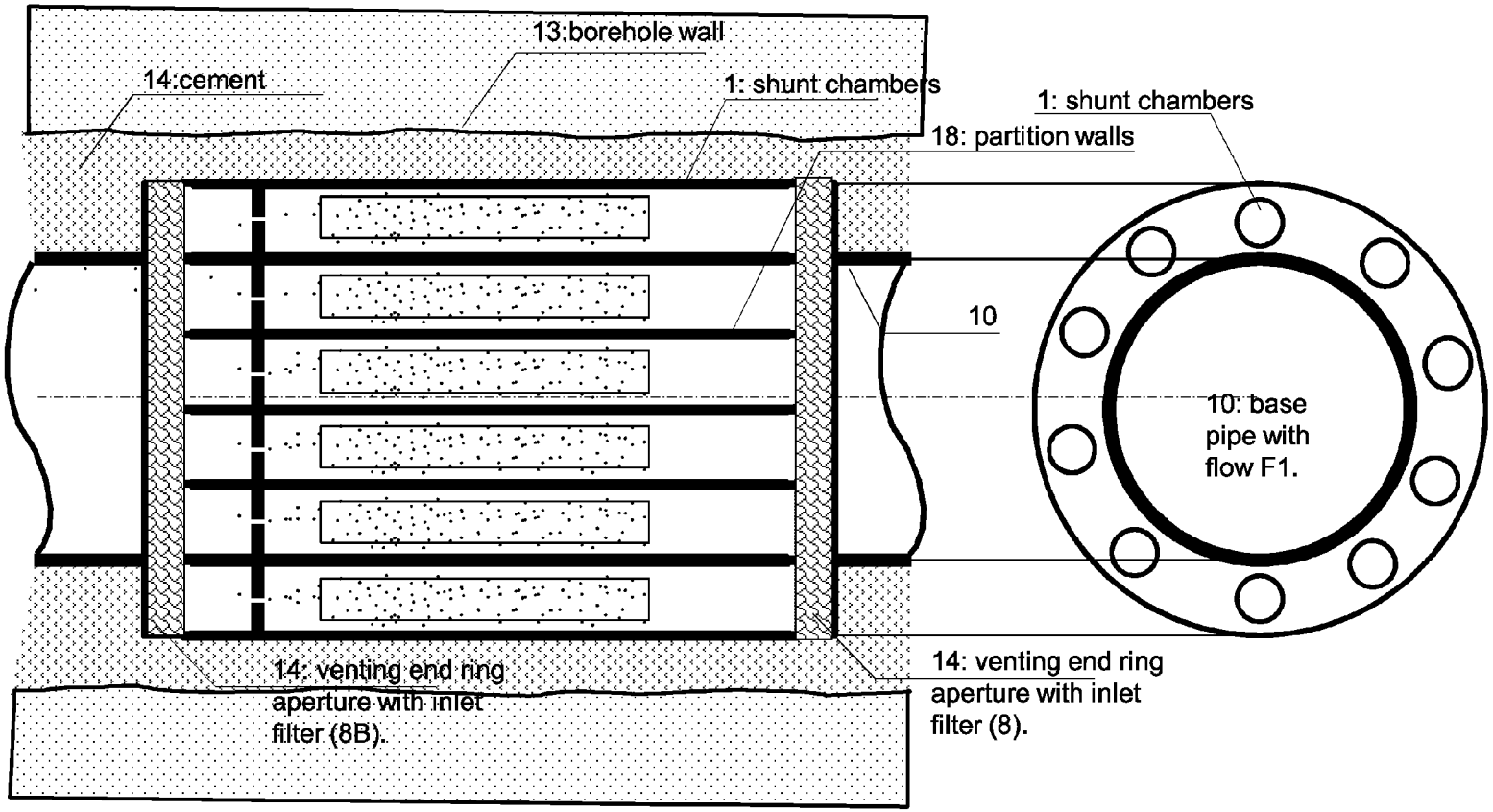
Figure 6B:
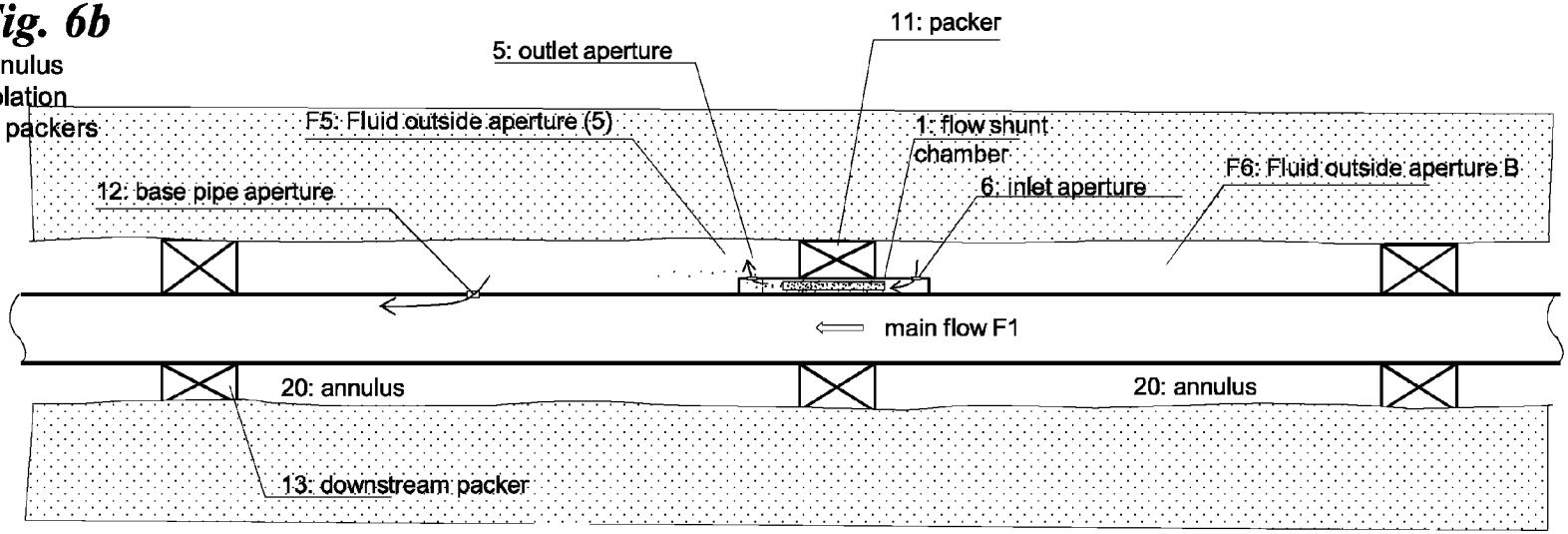

FIG. 6*b* is a view of the embodiment of FIG. 6*a* inserted at a smaller scale wherein the packer (11)—isolated annulus flow shunt chamber (1) is used in a so-called compartmentalized completions such as for ICV's and so-called "Frac sleeves". The pressure across the packer will thus drive a very small flow through the shunt flow passage (4), and the outside fluid (F5) is subsequently drained to the main flow (F1) through an aperture in the base pipe (10) downstream of the present packer-isolated annulus flow shunt chamber (1), and the pressure across the packer (11) may be estimated using the method of the present invention.

FIG. 6*a* illustrates in a longitudinal combined view of a cross-section of a base pipe (10) surrounded by cement (14) in the annulus (20) and a borehole wall (13), and in an open, elevation view of shunt flow chambers (1) of the invention enveloping the base pipe (10). A venting end ring (14) is arranged at either ends of the shunt flow chambers (1) so as for forming inlet apertures (6) and outlet apertures (5) for allowing fluid communication between the base pipe (10) and the flow passages (4). An advantage of this embodiment of the invention is that an axial-parallel array of perforation guns may be used to perforate the basepipe (10) without the risk of destroying more than one of the flow shunt chambers (1), and without destroying the venting end ring aperture (14).

FIG. 7 shows three graphs:

Upper:

calculated tracer flux versus time, for a step change in the topsides production rate.

Middle:

measured production rate topsides, given that there is only one production zone contributing in this example. The production rate at topside is changed in a step, resulting in a temporary change in tracer flux topsides.

Lower:

measured tracer (3) concentration in samples taken topsides, samples taken at given times.

The graphs in FIG. 7 are made for illustrating a tracer transient made by a step rate change of the fluid flow in the base pipe (10) (or the annulus (20), or a combination of the two), past the flow shunt chamber (1). A good example is in a situation illustrated in FIG. 2, wherein an inlet aperture (6) is from the base pipe (10) and the outlet aperture (5) is to the same base pipe (10).

Step-Up of Flow Rate

The flow rate ($\Phi 1_{topside}$) topsides is initially kept constant until time $t_{step}$, and we assume that the flow through the base pipe (10) is also initially kept constant. The topsides flow is successively sampled (at times marked by small circles in the lower graph). At $t_{step}$ there is an increase to flow rate ($\Phi 2_{basepipe}$), here illustrated as a doubling of the flow rate at time ($t_{step}$).

Measured Tracer Concentration

The steady flow rate topside will result in stable measured topsides tracer concentrations ($c1_{sample}(t_i)$), ($c2_{sample}(t_i)$), . . . ) measured and registered as function of ($t_i$) for sampling times i=1 to m. The measured concentration of tracer will, as illustrated in the lower curve continue to be constant as the fluid standing between the flow shunt chamber and downstream to the sampling site has been produced topsides. When the first flushed-out fluid (F3) from the flow passage (4) arrives topsides, the dilute fluid starts arriving at time $t_{arr}$, the actual flushout time being $t_{arr}-t_{step}$, and the concentration rapidly decreases asymptotically toward the lower, final expected concentration ($c1_{sample}$(final)), please see the lower curve, because the release rate ($\rho_{source}$) of tracer molecules (3) from the tracer system (2) is constant, and the influx of the diluting "fresh" fluid F6 from outside upstream inlet aperture (6) was abruptly increased, resulting in a steady decrease of the tracer flux out of outlet aperture (5).

Calculated Tracer Flux

Tracer flux is an amount of tracer material (3) which passes a given point, per time unit. For the method of the invention to work practically, each measured concentration ($c1_{sample}(t_i)$) measured must be corrected for the instantaneous topsides production flow ($\Phi_{topside}$) when the sample is taken, in order to calculate the topside tracer flux ($\rho_{topside}$) for each tracer molecule (3) type: ($\rho 1_{topside}$), ($\rho 2_{topside}$), . . . ($\rho_{topside}$) for ($t_i$) for i=1 to m. Then one arrives at a tracer flux curve which should resemble the upper curve of FIG. 7. The tracer flux curve which actually is a topside flow corrected curve, will carry more information to the user than the concentration curve alone, if utilized according to the method of the invention.

When the sudden step change in flow rate from flow rate ($\Phi 1_{basepipe}$) to flow rate ($\Phi 2_{basepipe}$) here illustrated as a doubling of the flow rate, the tracer flux ($\rho_{topside}$) will increase proportionally and suddenly double in the illustrated example, simply due to the fact that tracer material (3) already residing residing in the base pipe (10) upstream the flow shunt chamber (10) will be produced at the higher flow rate. However, and of course, the concentration ($c_{sample}$), in the upstream flow is still the same as long as the flush-out period up to $t_{arr}$ goes on during the actual flushout time $t_{arr}-t_{step}$. From the tracer flux curve after the onset of decrease at arrival time $t_{arr}$ one may analyze the linear function drop in tracer flux in order to find a parameter which characterizes the decrease. One such parameter used by the applicant is the so-called tracer transient time constant $t_{1/2}$, whereby the tracer flux has been reduced from ($\rho 1_{topside}$)=$T_1e^0$ to $T_1e^{-1/2}$.

FIG. 8 is an illustration of a special case wherein a production rampup (a step) is conducted after a total shutin. The production rate is changed from a first production rate ($\Phi_{topside}$), down to nil, and (in this example) back to the same, steady production rate. One will see from the tracer flux curve that it goes from a first steady level to nil and starts up again with a steady state level until the point in time where the accumulated dose starts to appear at $t_{app}$. The concentration curve during the shutin time is not really relevant to indicate any value for, but we have set it to nil here for the ease of the reader, although it is not really changed during the shutin. In other aspects the curves may be interpreted as before, with the same asymptotic approach to the initial tracer flux, which should be the same as the tracer release flux of the tracer (3) from the tracer system (2).

FIG. 9

Upper: This is a longitudinal section with a highly simplified illustration through a part of a producing well, this particular example showing the to end of a producing well.

Petroleum fluids seep in through the borehole wall from the surrounding reservoir rocks to the annulus space (10) and enter through a screen in the base pipe (10). We simply assume that the fluids are petroleum.

The middle graph is the fluid pressure in this part of the well, with pressure gradients dp2/dx2 and dp1/dx1 to be measured or compared.

The lower graph is an imagined production rate versus depth (NB: not vs. time) in the above base pipe. One may have a completion with several more flow shunt chambers (1) arranged along in this manner along a base pipe (10) in a completion from toe to heel in a producing well.

FIG. 10 comprises an overlay of two sets of curves similar to the curves of FIG. 7. The two sets of curves may illustrate a production scenario according to FIG. 9 above, with the toe—near influx being tracer flux zone 1 and the subsequent tracer flux zone 2 downstream of tracer tracer flux zone 1. The flow rate topside is in this example approximately doubled as shown in the middle graph.

It is assumed that the tracer source flux rate per time unit is the same for the two units, as indicated in the upper curve's initial part.

The lower set of graphs does not have tracer concentrations drawn exactly to scale. However, they both illustrate that the initial concentration of tracer from influx zone 1 is thinned due to the influx of petroleum in influx zone 2. But one could expect that the tracer from influx zone 2 would arrive ahead of tracer from influx zone 1, given that dispersion due to turbulence downstream does not smear the signals. The concentration differences does however not disturb the picture of the tracer fluxes which are corrected for the topside production rate.

Figure 10B:
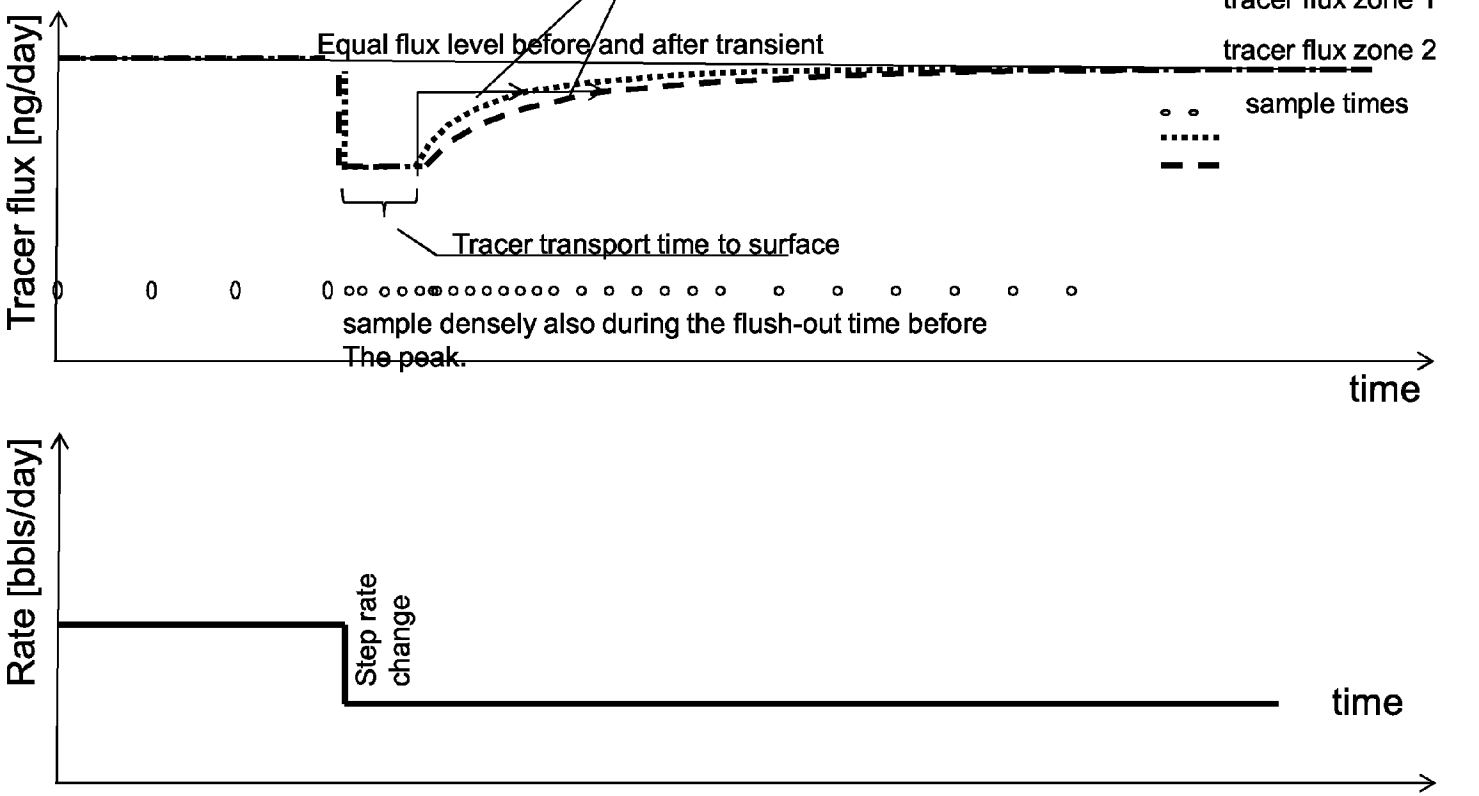

FIG. 10*b* shows two-zone monitoring by tracer transient with step negative rate change: the method still applies.

The big issue is to gather from measurements illustrated in FIG. 10, however, that from the tracer flux curves (actually the tracer flux data) the tracer transient time constants are calculated, and from those or the flow rates and thus the pressure differences through the shunt flow chambers (1) in influx zones 1 and 2 are calculated, and thus the pressure differences past the two flow chambers (1) are known. Voila, we do have two points on the base pipe pressure curve, alternatively the base pipe flow curve. As explained above, for each installed shunt flow chamber a point on the pressure curve, actually a point on the pressure gradient curve, may be established using the method of the present invention, please see FIG. 11.

FIG. 11 shows in the upper part an illustration of a well completion provided with multi-zone monitoring by tracer transient according to the invention, with step rate change in the production rate topside, using shunt flow chambers (1) installed on the base pipe. The petroleum fluid may be allowed to enter through screens arranged along the base pipe downstream of each shunt flow chamber. Using the method of the present invention pressure gradient points are obtained indicating petroleum inflow conditions along the well. The pressure gradient curve is illustrated for three different imagined producing well situations below, with pressure gradient curves for i) (longer broken lines) most inflow near the inner "toe" end of the reservoir zones, ii)(cont. line) even inflow along the production zones, and iii) (short broken lines) most inflow near the "heel" of the well.

FIG. 12 is a design drawing of an embodiment of the invention with a flow shunt chamber (1) arranged with inlet and outlet apertures (6, 5) through the wall of the base pipe (10). section, and with a flow restriction (7) at the middle.

In the upper left part of the drawing is shown an embodiment of a flow restrictor (7) as an enlarged view. In the upper right portion is an outward-looking "unwrap" view as seen fro the axis from inside the base pipe (10) showing inlet apertures (6) extending from the base pipe into the passage (4). Here they look the same as the outlet passages. The embodiment shown is without any filters (8, 8A) in the inlet and outlet apertures (6, 5), as the embodiment was tested on a pure liquid.

EMBODIMENTS OF THE INVENTION

With the present invention it is realized that that much can be gained by improving the design of such delay chambers and also by the usage of such delay chambers and the methods for utilizing such delay chambers and on interpreting tracer measurements resulting thereof. The inventor's objective is that the tracer carrier may be used so that flow information through the modulator device (=the delay chamber) is added to the tracer flux from the delay chamber. Modulations will be tracer transients so that the information can be read after being migrated through the downstream upper completions and tiebacks of short or long distance to a fluid sampling site. RESMAN has a patent application pending where <<voids with one or more apertures to the central base pipe flow>> is described.

Overall Purpose of the Invention:

The overall purpose of the invention is to estimate the pressure difference between inlet and outlet apertures (6 and 5), and thus provide some pressure gradients along the production zone, in order to estimate a pressure profile between a "toe" and a "heel" in a production zone by integrating the pressure gradient profile.

The invention illustrated in FIGS. 1 to 6*a, b*, and *c* is in general petroleum well tracer release flow shunt chamber (1), comprising a tracer system (2) arranged for releasing tracer molecules (3) to a shunt chamber fluid (F3) at any time present in said chamber (1), said tracer system (2) placed in said tracer release chamber (1) between a first, inlet aperture (5) and a second, outlet aperture (6) connecting said shunt chamber hydraulically with fluids (F5) and (F6) outside the flow shunt chamber, with a flow restrictor (7) inserted into the shunt flow passage (4) between said first, inlet aperture (5) and said second, outlet aperture (6) to create a controlled overall flow restriction to the shunt flow (Qs), so as to establish a flow (Qs) through the shunt chamber being driven by any pressure difference between the two apertures (5) and (6).

In an embodiment of the invention particle filters (8, 8B) are preferably inserted in one or both of outlet and inlet apertures (5) and (6) to reduce the risk of plugging the flow restrictor (7). Particularly it is important to have particle filter (8) installed in inlet aperture (6). The particle filter (8) may be installed just ahead of flow restrictor (7) in an embodiment of the invention.

Arrangement in the Completion in the Well

The flow shunt chamber (1) is arranged for extending generally axial-parallel with said basepipe (10). This is also parallel with and a desired basepipe flow (F1) if established, or at least with a desired annulus space (20) flow. The fluid (F5) is in the base pipe (10) or annulus space (20) and is transported directly or indirectly downstream for eventually being sampled and analyzed for tracer molecules (3). The fluid (F6) is in the base pipe (10) or in the annulus space (20). One must have control over the total fluid flow out of the well at any time, and the concentration of tracer molecules (3) in samples taken at a topsides sampling site. The term "base pipe" (10) used here is to be understood as the inner pipe in the production zone, also called the "central pipe" into which the production fluid flows and through which the production fluid flows downstream, usually at least to the wellhead or further topsides past the wellhead, such as to a production platform.

The invention illustrated in FIGS. 1, 1*a*, 2, 3, 4, 5, and 6 is a petroleum well tracer release flow shunt chamber (1) for being arranged in an annulus space (20) about a base pipe (10), i.e. a central pipe (10) in a petroleum well. The flow shunt chamber (1) extending generally axial-parallel with said basepipe (10). The flow shunt chamber (1) is provided with a shunt flow passage (4) for holding a shunt chamber fluid (F3) which generally is the fluid present and flowing slowly through the device of the invention. The flow shunt chamber (1) comprises the following main features:

- a tracer system (2) in the shunt flow passage (4), the tracer system (2) exposed to and arranged for releasing unique tracer molecules (3) at a generally even release time rate to said shunt chamber fluid (F3). The reason for using unique tracer molecules is due to the fact that one may then monitor tracer flux from several different flow shunt chambers arranged along the completion in a well.
- a first inlet aperture (6) to said flow shunt passage (4) is arranged for receiving a first fluid (F6) from outside said inlet aperture (6), i.e. upstream fluid from the base pipe, from the annulus space, or both.
- a second outlet aperture (5) from said shunt flow passage (4) arranged downstream of said first inlet aperture (6) said second outlet aperture (5) for releasing said shunt chamber fluid (F3) to a fluid (F5) outside said second outlet aperture (5), which also may be to the base pipe, the annulus space, or both.
- a flow restrictor (7) arranged between said tracer system (2) and said second outlet aperture (6), allowing a pressure gradient between said inlet and outlet apertures (6, 5) driving said shunt chamber fluid (F3) out via said flow restrictor (7). The flow restrictor (7) may be a selectable plug with a pinhole or a plug with a screw adjustable hole, which may be arranged in the workshop during assembly of the flow shunt chamber or during calibration of the flow shunt chamber.

The petroleum well tracer release flow shunt chamber (1) of claim 1, said tracer system (2) arranged for releasing said tracer molecules (3) at a steady release rate (versus time) to said into said surrounding shunt chamber fluid (F3). This may be achieved by the applicant's tracer systems (2) which may be embodied as a polymer based rod which releases tracer molecules (3) at least a steady time release rate after an initial wetting period in said petroleum well fluid. The petroleum well tracer release flow shunt chamber (1) of an embodiment said tracer system (2) comprises a matrix (22) arranged for releasing said tracer molecules (3) by a diffusion-like process at a steady time release rate to said into said surrounding shunt chamber fluid.

Particle Filters

In an embodiment of the invention illustrated The petroleum well tracer release flow shunt chamber (1) of any of the preceding claims, said flow shunt chamber (1) provided with a first particle filter (8) in said flow shunt passage (4) between inlet aperture and said flow restrictor (7). In an embodiment of the petroleum well tracer release flow shunt chamber (1) of the invention, the inlet aperture (6) is provided with said first particle filter (8). The petroleum well tracer release flow shunt chamber (1) may also be provided with a second particle filter (8A) between said flow restrictor (7) in said flow shunt passage (4) and said second, outlet aperture (5). The second outlet aperture (5) may also be provided with said second particle filter (8A).

In general, said first inlet aperture (6) is directly fluid communicating via said shunt flow passage (4) and said flow restrictor (7) to said second outlet aperture (5). The flow shunt chamber may in an embodiment be provided with a check valve (40) to allow fluids to flow through the shunt chamber in one direction only; from the inlet aperture (6) end towards the outlet aperture end (5).

Mounting

In the illustrated and preferred embodiment of the invention said flow shunt chamber (1) is placed in said annulus (20) formed outside of said base pipe (10) in said petroleum well. The illustrations show a side pocket mandrel-like flow shunt chamber (1) mounted at the outer wall of the base pipe, with appropriate apertures towards the base pipe, the annulus, or both. A barrel-like array such as the one in FIG. 6*b* is also envisaged, cemented in the annulus or not. Placement of the flow shunt chamber at the inner wall is possible, but may be undesirable because it would present possible obstacles to logging tools, valve tools, intervention tools, and to the base pipe flow itself. Such a variety of the present invention is thus not significantly different from the embodiments illustrated.

Various Inlet and Outlet Directions

In an embodiment of the invention illustrated in FIGS. 2 and 3, said apertures (5) and (6) are hydraulically connected to the fluids in said base pipe (10) so that the shunt flow Qs is a function of the pressure distribution along the base pipe's (10) interior, the base pipe (10) being either a blank pipe section (FIG. 2) or a perforated section (FIG. 3) or a combination of the two. This will enable the user to measuring pressure drop between said apertures A and B in said base pipe.

In an embodiment illustrated in FIG. 6*a* the tracer release flow shunt chamber of the invention is embodied as a number of such shunt chambers (1) mounted in a barrel-like array around the circumference of the base pipe (10) and sealingly cemented by cement (14) to the borehole wall (13). The inlet apertures (6) are mutually connected by a first venting end ring (14) open inwardly to said base pipe (10), the outlet apertures (5) are also mutually connected by a second venting end ring (14) open inwardly to said base pipe (10), the shunt chambers (1) are fully isolated from each other between said end rings (14) by partition walls (18). Thus the barrel array is arranged for a line of perforations to be shot by a linear gun array so that one or two of the shunt chambers (3) are directly hydraulically connected to the surrounding fluids, all other shunt chambers (3) are intact and will continue to operate.

Aperture to Annulus and Base Pipe

According to an embodiment of the invention illustrated in FIG. 4, the inlet aperture (6) is hydraulically connected to said annulus (20), said outlet aperture (5) connected to said base pipe (10), so as for measuring pressure drop from said annulus to said base pipe. In the illustrated case wherein there is a base pipe screen or perforation upstream or downstream it will still measure the pressure difference in the main flow and the annulus flow from inlet aperture (6) to outlet aperture (5). If arranged on a blank pipe it will measure the pressure difference across the base pipe wall.

Annulus Flow

In an embodiment illustrated in FIG. 5, both said inlet aperture (6) and said outlet aperture (5) are hydraulically connected to said annulus (20), so as for measuring the pressure gradient in the annulus (20). This is illustrated with a blank pipe, but an embodiment with a screen or apertures in the base pipe is envisaged.

Across Packer Measurement

In the embodiment illustrated in FIGS. 6 and 6*b*, the tracer release flow shunt chamber of the invention comprises a zonal isolating packer (11) isolating about said tracer release flow shunt chamber (1) and said base pipe (10) between said inlet apertures (6) and said outlet aperture (5) and so that annulus flow is blocked, the main flow in the base pipe is allowed and a shunt flow, which will be much less than the main flow, is also allowed. (FIG. 6), so as for measuring pressure across said packer.

Completion

The invention is also a petroleum well completion comprising a base pipe (10) with an annulus space (20) in a petroleum well please see FIG. 11, comprising one or more tracer release flow shunt chambers (1) as described above, arranged along said base pipe (10). They may be arranged according to the desire of the well operator with apertures to the base pipe only, to the annulus only, or across packers, all as described above, and in different embodiments along the well.

Several Chambers in One Location

In an embodiment of the invention, two or more flow shunt chambers (1) with the same unique tracer molecule (3) type are arranged about a circumference of said base pipe (1) at a location along said base pipe (1), in order to strengthen the concentration of the released tracer, particularly in case of high fluid flow past said flow shunt chambers (1) locally, for obtaining a significantly detectable tracer concentration topsides arising from that location.

In an embodiment of the invention, the base pipe (10) comprises one or more screen portions (17) or perforations upstream or downstream of one or more of said tracer release chambers (1). This may balance the flow between the base pipe (10) and the annulus (20), but anyway also balance out any longitudinal pressure differences, and thus release according to pressure difference.

Method

The invention is a method of estimating one or more pressure differences or gradients along a producing petroleum well with a completion with a base pipe (10) in an annulus (20) and with one or more flow shunt chambers (1) according to the above description, having unique tracer molecules (3) for each depth along the base pipe (10) and arranged along part or all of said base pipe (10), particularly at least through the relevant influx zones of the well, allowing well fluids to flow at a stable, first production flow rate, and changing said flow to a second production flow rate, all while collecting a time-stamped series of fluid samples from said well fluids at a topsides sampling location, analyzing said series of fluid samples for concentrations of said tracer molecules (3), calculating topsides tracer flux rate versus time curves from said concentrations and said flow rates for each tracer molecule (3) type, identifying tracer flux transients associated with the change to said second production flow rate, based on said tracer flux rate curves, calculating time constants for each tracer flux transient for each tracer molecule (3) type for said flow shunt chambers (1), based on said time constants, estimating a pressure difference between said inlet aperture (6) and said outlet aperture (1) of each flow shunt chamber (1).

Relative Pressure Differences

In an embodiment of the invention one estimates the relative pressure differences of two or more flow shunt chambers (1) based on ratios between their corresponding calculated time constants. In order to achieve this one needs to know the relative release properties of the compared flow shunt chambers as a function of pressure difference, of which chambers the flow has passed.

Absolute Pressure Differences

In an embodiment of the invention, one may estimating absolute pressure differences over one or more flow shunt chamber (1) based on a calibration of said flow shunt chamber's (1) time constant for one or more known pressure differences between said inlet aperture (6) and said outlet aperture (5). Each said flow shunt chamber (1) is arranged with a first, inlet aperture (6) for outside fluid (F6) to enter a flow shunt passage (4) with a unique tracer system (2) (for that particular depth) exposed to and arranged for releasing tracer molecules (3) at a generally even release time rate to a shunt chamber fluid (F3), and with a second, outlet aperture (5) from said shunt flow passage (4) arranged downstream of said first inlet aperture (6), for releasing said shunt chamber fluid (F3) to a fluid (F5) outside said second outlet aperture (5). In practice, arranging said flow shunt chamber (1) extending generally axial-parallel with said basepipe (10). The flow shunt chamber (1) is provided with a flow restrictor (7) between said tracer system (2) and said second outlet aperture (6), allowing a pressure gradient between said inlet and outlet apertures (6, 5) to drive said shunt chamber fluid (F3) through said flow restrictor (7).

The flow shunt chamber may in an embodiment of the invention advantageously be calibrated before installation of the completion in the well, but may also be calibrated by measuring in-site pressure differences with other pressure meters arranged in parallel with the flow shunt chamber installed. The calibration of said flow shunt chamber (1) may be conducted by measuring the time constant for a given, known tracer system (2) leaking out a given, known tracer molecule (3) type under a known pressure difference in the laboratory (or in the well). During such calibration one should use petroleum fluids of known viscosity and composition and temperature. The flow restrictor (7) in the shunt flow passage (4) is literally the bottleneck of the flow shunt chamber (1), please see FIG. 1*c*, it controls the time constant. The time constant may thus be changed by replacing the flow restrictor (7) with another flow restrictor (7) with different aperture, or adjusting the aperture of the flow restrictor (7). The flow restrictor may comprise an interchangeable flow restrictor plug (70) in the flow passage (4), the flow restrictor plug (70) provided with a flow restrictor passage (72) of a given cross-section area. Alternatively, adjusting the flow restrictor (7) may be done e.g. by adjusting the cross-section of the flow restrictor passage (72) by means of a flow adjustment screw (71) in the flow restrictor plug passage (72) in the flow restrictor plug (70).

In practice, we are arranging said flow shunt chamber (1) extending generally axial-parellel with said basepipe (10).

Optionally, if it is allowed to partly block the passage in the base pipe (10), we may arrange the flow shunt chamber (1) on the inner wall of the base pipe (10) or in a side pocket mandrel (10S).

In an embodiment of the method of the invention, it is used a tracer system (2) arranged for releasing said tracer molecules (3) at a steady time release rate into the surrounding shunt chamber fluid (F3).

In an embodiment of the invention we are using or calibrating one or more of said flow restrictors (7) to provide time constants ($t_{i1/2}$) equal to or longer than flushout times ($t_{iarr}$) from said flow shunt chamber (1) to said topsides sampling site, in order to provide a robust tracer flux signal pulse.

Basic Assumptions:

Proportional Flow and Pressure Difference:

The higher the pressure difference is between inlet (6) and outlet (5), the faster the fluid volume flux ($\Phi_{chamber}$) through the flow passage (4) becomes, the higher the dilution of released molecules (3) into the flow passage (4) becomes, and the lower the concentration of molecules (3) in the flow chamber fluid (F3) becomes. This is for constant, steady flow conditions over a time that is long enough to create even tracer molecule distribution in the shunt chamber (1). If the flow restrictor (7) is obeying Darcy's law (narrow tubes, porous media) the relationship between flow and pressure difference becomes (linearly) proportional, and thus it is possible to calibrate the flow shunt chamber (1).

Proportional Fluid Flows in Base Pipe (10) and Shunt Flow Chamber (1):

One may assume in a simplified model of the fluid flows through the flow shunt chamber (1) and the base pipe (10) that fluid flow ($\Phi_{chamber}$) through the shunt flow passage (4) is proportional or linearly related to the fluid flow ($\Phi_{basepipe}$) through the base pipe (10), given that the pressure difference ($P_6$-$P_5$) over the same distance along them are the same. The fluid flow rates ($\Phi_{chamber}$), ($\Phi_{basepipe}$), ($\Phi_{annulus}$) are denoted in volume per time unit; liters/s.

Calibration of Shunt Flow Chamber (1):

Depending particularly on the flow restrictor (7), the proportional or otherwise linearly related ratio of fluid flow per time unit distributed between the flow passage (4) and the base pipe (10), ($\Phi_{chamber}$)/($\Phi_{basepipe}$) may be determined or calibrated before installation of the basepipe and completion section component with the shunt flow chamber (1).

Similarly, the ratio of fluid flow per time unit distributed between the flow passage (4) and the annulus (20) ($\Phi_{chamber}$)/($\Phi_{annulus}$), or between the flow passage (4) and the combined flow through base pipe (10) and the annulus (20), may be calibrated in the laboratory before installation of the completion. The desired calibration depends on which flows the first and second apertures (6, 5) are adjacent to.

Overall Considerations on Tracer Flux($\phi$):

It is important to note that the source release time rate ($\rho_{source}$) still is constant. As long as the tracer system (2) has a generally constant tracer release rate ($\rho_{source}$), the averaged tracer flux ($\phi_{average}$) topsides as measured over a long time period should be constant: ($\rho_{source}$)=($\rho_{average}$)

Halt or Reduced Throughflow ($\Phi_{chamber}$):

A standstill or even for a reduction of the fluid throughflow ($\Phi_{chamber}$) of the fluid (F3) through the flow passage (4) will accumulate released molecules (3) at the source release time rate ($\rho_{source}$) anyhow, so the concentration ($C_{chamber}$) of molecules (3) in the flow passage (4) is thickened by a decreased fluid flow ($\Phi_{chamber}$) and thus the concentration ($c_{chamber}$) of molecules (4) in the flow passage (4) increases.

Increased Throughflow ($\Phi_{chamber}$):

Oppositely, an increase of the fluid throughflow ($\Phi_{chamber}$) of the fluid (F3) through the flow passage (4) will still accumulate released molecules (3) at the source release time rate ($\rho_{source}$) anyhow, so the concentration ($c_{chamber}$) of molecules (3) in the fluid flow passage (4) is thinned by an increased fluid flow ($\Phi_{chamber}$), and thus the concentration ($c_{chamber}$) of molecules (4) in the flow passage (4) decreases.

Release from the Flow Shunt Chamber (1)

The flow with molecules of said shunt chamber fluid (F3) is released to the basepipe flow (F5) further out of outlet aperture (5) where it mixes into the outside flow (F5) and is eventually picked up topsides where samples may be taken from the basepipe flow for being analyzed for concentration. What is here called the "outside flow" (F5) depends on whether the second, downstream aperture (5) is to the base pipe directly, to the annulus flow directly, or to a screen between the two.

Topsides Sampling and Analysis.

A continuous measurement of production flows of oil, water and gas topsides must of course be recorded. Samples are taken at desired points in time depending on the progress of the method according to the invention. The samples are analyzed for the presence of each of the installed tracer carriers' (2) molecule ($\mathbf{3}_1, \mathbf{3}_2, \ldots, \mathbf{3}_n$) types installed in the flow shunt chambers (1) along the base pipe. The samples are collected as a function of time, as mentioned above. The topsides concentrations ($c\mathbf{1}_{sample}(t_i)$), ($c\mathbf{2}_{sample}(t_i)$), . . . ($cn_{sample}(t_i)$) are registered as function of ($t_i$) for i=1 to m. Further, each concentration ($c\mathbf{1}_{sample}(t_i)$) must, for the method to work, be corrected for the instantaneous topsides production flow ($\Phi_{topside}$) when the sample is taken, in order to calculate the topside tracer flux ($\rho_{topside}$) for each tracer molecule (3) type: ($\Phi\mathbf{1}_{topside}$), ($\rho\mathbf{2}_{topside}$), . . . ($\rho_{topside}$) for ($t_i$) for i=1 to m. Then one arrives at curves which should resemble FIG. 7.

FIG. 7 shows graphs of measurements of tracer flux measurements versus time, for a step change in the topsides production rate. The production rate at topside is changed, resulting in a temporary change in tracer flux topsides. For other varieties please see below.

The characteristic time (or characteristic flow volume) to go from a peak tracer flow to a given lower tracer flow level may be used to calculate the flow through the base pipe (10) or the annulus (20) or combined for both the base pipe (10) and the annulus (20).

Obtaining a Robust Tracer Flux Signal

Figure 9:
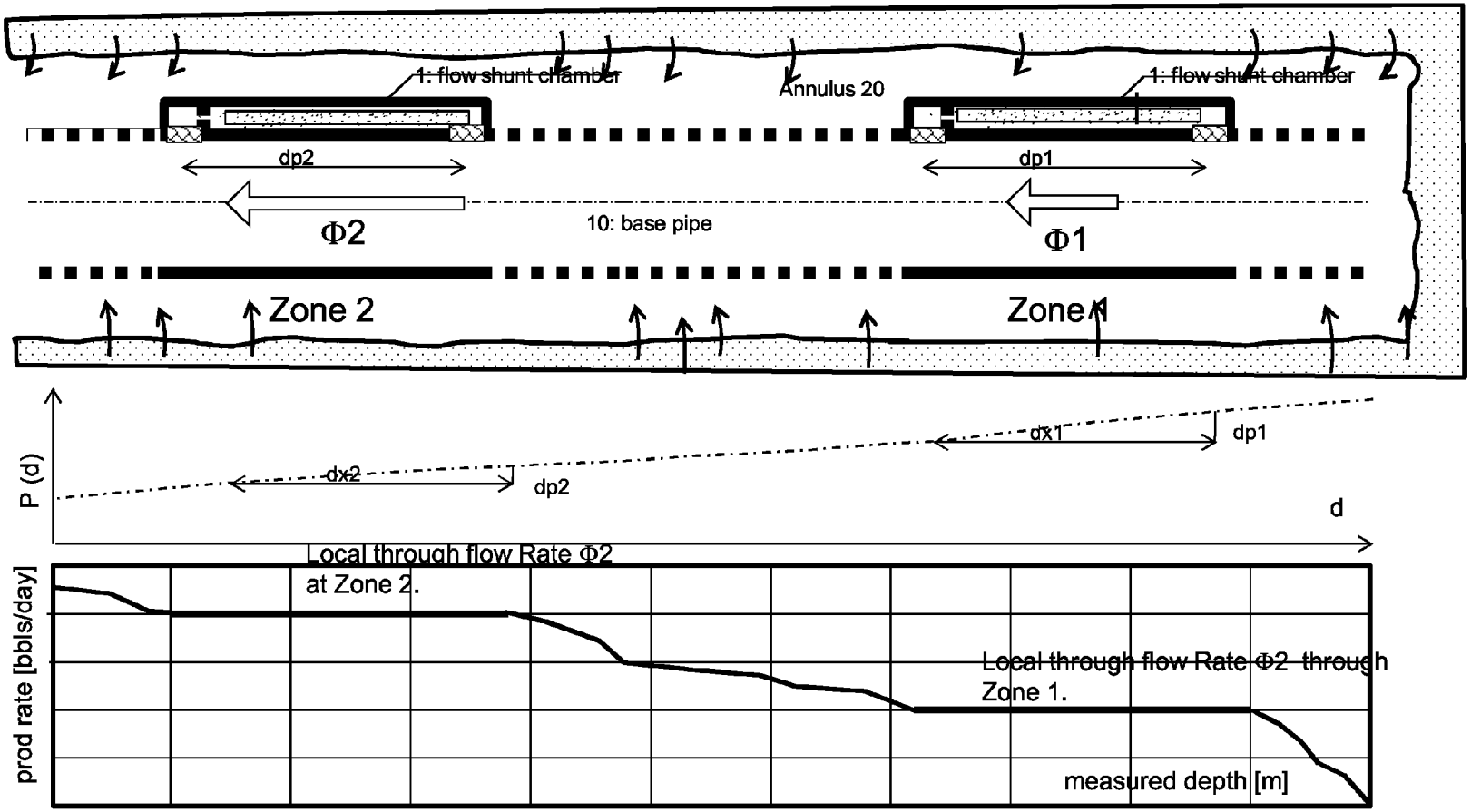

For the situations illustrated and described in connection with FIGS. 7, 8, 9, (and the below FIG. 11) For obtaining a good tracer flux curve with robust data it is an advantage to calibrate the flow shunt chamber with the flow restrictor (7) so as for obtaining a time constant $t_{1/2}$ on the same order of the duration of the plateau in the time interval between $t_{step}$ and $t_{arr}$.

Preferably $t_{1/2}>(t_{arr}-t_{step})$.

This will make the tracer flux signal sufficiently robust to survive turbulent mixing through the downstream tubing between the flow shunt chamber (1) and the topsides sampling site.

The first inlet aperture (6) is at a relatively higher pressure than the downstream second outlet aperture (5). This may be due to said first inlet aperture (6) being in fluid communication with an upstream part of said base pipe (10) or said annulus (20) or both, and said outlet aperture (5) being in fluid communication with a downstream part of said base pipe (10) or said annulus (20) or both. The pressure decreases in a downstream direction generally; this is why fluids flow through the base pipe (10) or annulus (20), and in particular through the passage (4) of the device of the present invention. The pressure difference (or gradient) drives a flow through the passage (4) from the inlet aperture (6) through the outlet aperture (5). Which parameters that control, restrict or brake the flow of the shunt chamber fluid (F3) through the passage (4) are:

inertia (negligible),
fluid friction (parallel flow or turbulent flow),
the fluid restrictor (7),
viscosity,
temperature, and
possible clogging at the inlet aperture (6).

In general, without the fluid restrictor (7), the flushout time from the passage (4) through flow shunt chamber (1) would be rather short, and the flow through would be large, and the release time for the shunt chamber fluid rather short compared to the flushout time downstream through the production tubing and the tie-back to the petroleum platform. Thus it could be difficult to obtain a well detectable tracer flux pulse peak. The fluid restrictor (7) (which may be integrated with the outlet aperture (5) or arranged in the passage (4) between the tracer system (2) and the outlet aperture (5), may be designed as the "bottleneck" controlling component of the passage (4) as illustrated in FIGS. 1, 2 and 3, and be made adjustable or exchangeable to a desired flow-through property.

The invention claimed is:

1. A petroleum well tracer release flow shunt chamber for being arranged in an annulus space about a base pipe in a petroleum well said flow shunt chamber extending generally axial-parallel with said basepipe, said flow shunt chamber provided with a shunt flow passage for holding a shunt chamber fluid, said flow shunt chamber comprising:

a tracer system in said shunt flow passage, said tracer system exposed to and arranged for releasing unique tracer molecules at a generally even release time rate to said shunt chamber fluid, a first inlet aperture to said flow shunt passage for receiving a first fluid from outside said inlet aperture, a second outlet aperture from said shunt flow passage arranged downstream of said first inlet aperture said second outlet aperture for releasing said shunt chamber fluid to a fluid outside said second outlet aperture, and a flow restrictor arranged between said tracer system and said second outlet aperture, allowing a pressure gradient between said inlet and outlet apertures driving said shunt chamber fluid out via said flow restrictor.

2. The petroleum well tracer release flow shunt chamber of claim 1, said tracer system arranged for releasing said tracer molecules at a steady release time rate to said surrounding shunt chamber fluid.

3. The petroleum well tracer release flow shunt chamber of claim 1, said tracer system comprising a matrix arranged for releasing said tracer molecules by a diffusion-like process at a steady time release rate ($\rho_1$) to said into said surrounding shunt chamber fluid.

4. The petroleum well tracer release flow shunt chamber of claim 1, said flow shunt chamber provided with a first particle filter in said flow shunt passage between inlet aperture and said flow restrictor.

5. The petroleum well tracer release flow shunt chamber of claim 4, said inlet aperture provided with said first particle filter.

6. The petroleum well tracer release flow shunt chamber of claim 1, said flow shunt chamber provided with a second particle filter between said flow restrictor in said flow shunt passage and said second, outlet aperture.

7. The petroleum well tracer release flow shunt chamber of claim 6, said second outlet aperture provided with said second particle filter.

8. The petroleum well tracer release flow shunt chamber of claim 1, said first inlet aperture directly fluid communicating via said shunt flow passage and said flow restrictor to said second outlet aperture.

9. The petroleum well tracer release flow shunt chamber of claim 1, said flow shunt chamber provided with a check valve to allow fluids to flow through the shunt chamber in one direction only.

10. The petroleum well tracer release flow shunt chamber of claim 1, said flow shunt chamber placed in said annulus formed outside of said base pipe in said petroleum well.

11. The petroleum well tracer release flow shunt chamber of claim 10, said apertures being hydraulically connected to the fluids in said base pipe so that the shunt flow $Q_s$ is a function of the pressure distribution along the base pipe's interior, the base pipe being either a blank pipe section or a perforated section or a combination of the two.

12. The tracer release flow shunt chamber of claim 11, wherein a number of the shunt chambers mounted in a barrel array around the circumference of the base pipe, and wherein:

said inlet apertures are mutually connected by a first venting end ring open inwardly to said base pipe, said outlet apertures are also mutually connected by a second venting end ring open inwardly to said base pipe, and said shunt chambers are isolated from each other between said end rings by partition walls.

13. The tracer release flow shunt chamber of claim 12, said barrel array around the circumference of the base pipe sealingly cemented by cement to the borehole wall.

14. The petroleum well tracer release flow shunt chamber of claim 10, said inlet aperture being hydraulically connected to said annulus, and said outlet aperture connected to said base pipe, so as for measuring pressure drop from said annulus to said base pipe.

15. The petroleum well tracer release flow shunt chamber of claim 10, both said inlet aperture and said outlet aperture being hydraulically connected to said annulus, so as for measuring the pressure gradient in the annulus.

16. The tracer release flow shunt chamber of claim 10, comprising a zonal isolating packer isolating about said tracer release flow shunt chamber and said base pipe between said inlet apertures and said outlet aperture and so that annulus flow is blocked, but a shunt flow is allowed, so as for measuring pressure across said packer.

17. A petroleum well completion comprising a base pipe with an annulus space in a petroleum well, comprising one or more tracer release flow shunt chambers, according to claim 1, arranged along said base pipe.

18. The petroleum well completion of claim 17, said flow shunt chamber placed in said annulus formed outside of said base pipe in said petroleum well, said apertures being hydraulically connected to the fluids in said base pipe so that the shunt flow $Q_s$ is a function of the pressure distribution along the base pipe's interior, the base pipe being either a blank pipe section or a perforated section or a combination of the two.

19. The petroleum well completion of claim 18, wherein a number of the shunt chambers mounted in a barrel array around the circumference of the base pipe, and wherein:

said inlet apertures are mutually connected by a first venting end ring open inwardly to said base pipe, said outlet apertures are also mutually connected by a second venting end ring open inwardly to said base pipe, and said shunt chambers are isolated from each other between said end rings by partition walls.

20. The petroleum well completion of claim 19, said barrel array around the circumference of the base pipe sealingly cemented by cement to the borehole wall.

21. The petroleum well completion of claim 17, said flow shunt chamber placed in said annulus formed outside of said base pipe in said petroleum well, said inlet aperture being hydraulically connected to said annulus, and said outlet aperture connected to said base pipe, so as for measuring pressure drop from said annulus to said base pipe.

22. The petroleum well completion of claim 17, comprising two or more flow shunt chambers with the same unique tracer molecule type arranged about a circumference of said base pipe at a location along said base pipe, in order to strengthen the concentration of the released tracer in case of high fluid flow past said flow shunt chambers locally, for obtaining a significantly detectable tracer concentration topsides arising from that location.

23. The petroleum well completion of claim 17, said base pipe comprising one or more screen portions or perforations upstream or downstream of one or more of said tracer release chambers.

24. A method of estimating one or more pressure differences or gradients along a producing petroleum well with a completion with a base pipe in an annulus and with one or more flow shunt chambers according to claim 1 with unique tracer molecules and arranged along part or all of said base pipe, said method comprising the steps of:

allowing well fluids to flow at a stable, first production flow rate ($\Phi 1_{topside}$), and changing said flow to a second production flow rate ($\Phi 2_{topside}$), all while collecting a time-stamped series of fluid samples from said well fluids at a topsides sampling location, analyzing said series of fluid samples for concentrations ($c1_{sample}(t_i)$), ($c2_{sample}(t_i)$), ($cn_{sample}(t_i)$), calculating topsides tracer flux rate ($\rho_{topside}$) versus time curves from said concentrations ($ci_{sample}(t_i)$) and said flow rates ($\Phi\iota_{topside}$) for each tracer molecule type, identifying tracer flux transients associated with the change to said second production flow rate, based on said tracer flux rate curves, calculating time constants ($t_{i1/2}$) for each tracer flux transient for each tracer molecule type for said flow shunt chambers, based on said time constants ($t_{i1/2}$), estimating a pressure difference between said inlet aperture and said outlet aperture of each flow shunt chamber.

25. The method of claim 24, further comprising the step of estimating relative pressure differences of two or more flow shunt chambers based on ratios between their corresponding calculated time constants ($t_{i1/2}$).

26. The method of claim 24, further comprising the step of estimating absolute pressure differences over one or more flow shunt chamber based on a calibration of said flow shunt chamber's time constant ($t_{i1/2}$) for one or more known pressure differences between said inlet aperture and said outlet aperture.

27. The method of claim 23, further comprising the step of using a tracer system arranged for releasing said tracer molecules at a steady time release rate ($\rho_1$) to said into said surrounding shunt chamber fluid.

28. The method of claim 23, further comprising the step of using or calibrating one or more of said flow restrictors to provide time constants ($t_{i1/2}$) equal to or longer than flushout times ($t_{iarr}$) from said flow shunt chamber to said topsides sampling site, in order to provide a robust tracer flux signal pulse.

* * * * *